US010933626B1

(12) United States Patent
Bullington et al.

(10) Patent No.: US 10,933,626 B1
(45) Date of Patent: Mar. 2, 2021

(54) METHOD OF DECORATING A CONTAINER USING A DECORATING MACHINE HAVING A PLURALITY OF INDEPENDENTLY CONTROLLED PRINT WORKSTATIONS

(71) Applicant: LSINC Corporation, Huntsville, AL (US)

(72) Inventors: James Richard Bullington, Athens, AL (US); Christopher Shea Curry, Fayetteville, TN (US); Michael Devon Hunter, Huntsville, AL (US)

(73) Assignee: LSINC Corporation, Huntsville, AL (US)

( * ) Notice: Subject to any disclaimer, the term of this patent is extended or adjusted under 35 U.S.C. 154(b) by 0 days.

(21) Appl. No.: 16/899,526

(22) Filed: Jun. 11, 2020

Related U.S. Application Data

(63) Continuation-in-part of application No. 16/885,608, filed on May 28, 2020.

(60) Provisional application No. 62/978,817, filed on Feb. 20, 2020.

(51) Int. Cl.

| | |
|---|---|
| ***B41M 1/40*** | (2006.01) |
| ***B41J 3/407*** | (2006.01) |
| ***B41F 17/18*** | (2006.01) |
| ***B41F 17/00*** | (2006.01) |
| ***B41M 5/00*** | (2006.01) |

(Continued)

(52) U.S. Cl.

CPC ..... *B41F 17/18* (2013.01); *B41F 17/002* (2013.01); *B41F 23/04* (2013.01); *B41J 3/4073* (2013.01); *B41J 3/40733* (2020.08); *B41M 1/40* (2013.01); *B41M 5/0082* (2013.01); *B41M 5/0088* (2013.01); *B41M 7/0081* (2013.01)

(58) Field of Classification Search

CPC ..... B41F 17/002; B41F 17/18; B41F 17/20; B41F 17/22; B41J 3/4073; B41J 3/40733; B41M 1/40; B41M 5/0088; B41M 5/0082

USPC ..... 101/38.1; 347/4

See application file for complete search history.

(56) References Cited

U.S. PATENT DOCUMENTS

| | | | | |
|---|---|---|---|---|
| 3,960,073 | A | 6/1976 | Rush | |
| 4,543,883 | A | 10/1985 | Skrypek et al. | |
| 9,327,493 | B1 * | 5/2016 | Vella | B41J 3/4073 |

(Continued)

FOREIGN PATENT DOCUMENTS

| | | | | |
|---|---|---|---|---|
| CN | 106427209 A | * | 2/2017 | B41J 3/40733 |
| CN | 110450550 A | * | 11/2019 | B41J 3/4073 |

*Primary Examiner* — Leslie J Evanisko

(74) *Attorney, Agent, or Firm* — The Gache Law Firm, P.C.; Russell C. Gache

(57) ABSTRACT

The invention is a method of using a turret styled decorator machine to decorate container media. The machine utilized has a rotatable turret and a number of circumferentially spaced container holding assemblies for holding a variety of pieces of "media," such as a drink container, the exterior surface of which is to have ink applied to form an image. A plurality of workstations are positioned around the perimeter of the turret through which each media holder passes as the turret rotates. Due to the unique configuration of the decorating machine, each piece of media, once loaded, spins at a rate different from any other piece of media so that the entire decorating process is speed optimized for each print job. Further, container media may spin continuously during the decorating process so that the turret never needs to pause for media to stop rotating or to begin rotating.

20 Claims, 18 Drawing Sheets

(51) Int. Cl.
*B41F 23/04* (2006.01)
*B41M 7/00* (2006.01)

(56) References Cited

U.S. PATENT DOCUMENTS

| | | | | |
|---|---|---|---|---|
| 9,517,640 | B2 * | 12/2016 | Till | B41J 3/4073 |
| 10,442,212 | B2 * | 10/2019 | Belval | B41J 3/4073 |
| 2012/0017783 | A1 * | 1/2012 | Uptergrove | B41F 17/18 101/38.1 |
| 2014/0288632 | A1 | 9/2014 | Soletti et al. | |
| 2016/0257133 | A1 | 9/2016 | Vella | |

* cited by examiner

METHOD OF DECORATING A CONTAINER USING A DECORATING MACHINE HAVING A PLURALITY OF INDEPENDENTLY CONTROLLED PRINT WORKSTATIONS

This application claims the benefit of filing priority under 35 U.S.C. § 119 and 37 C.F.R. § 1.78 of the U.S. provisional Application Ser. No. 62/978,817 filed Feb. 20, 2020, for a SYSTEM AND METHOD FOR A CONTAINER DECORATING MACHINE. All information disclosed in that prior pending nonprovisional application is hereby incorporated by reference.

FIELD OF THE INVENTION

The present invention relates generally to machinery and, in particular, to container decorating machines. In greater particularity, the present invention relates to rotating or "turret" type decorating machines and, in particular, such machines that have a plurality of discrete workstations around the periphery of the turret.

BACKGROUND OF THE INVENTION

Rotating, continuous motion machines for decorating containers, commonly referred to as container decorator machines or simply container decorators, are well known in the art. A known decorator system representative of the art is disclosed in U.S. Pat. No. 5,771,798. The apparatus disclosed in that patent includes a rotatable printing wheel having a generally cylindrical outer surface and rotated by electrical means. A plurality of circumferential spaced printing plates are mounted on and project radially outwardly from the generally cylindrical outer surface, and each of these plates holds a printable image in a radially projected direction. Each image on each plate varies. The configuration includes multiple spaced inking stations mounted at locations spaced from the arcuately shaped printing images in a radial direction, and a roller applies ink to each plate for transferring an inked image to the surface of each container and, typically, each station applies a different color of the same image. A drive means is provided to rotate a holding means to rotate each container body, and a curing means such as an ultra violet energy source is provided for drying at least a portion of the coating of ink transferred to the ink on the container surface in preparation for a subsequent ink coating to be applied. A conveying means is included for receiving containers and movement of the printed containers to each ink station or for further processing. The limitation with the U.S. Pat. No. 5,771,798 is that the design relies upon a plurality of printing plates to convey an image onto each container article. Printing plates, generally, are not editable on the fly but must be manually removed and replaced with newly formed plates to change the design to be applied to any container article. Further, a change in size of a container article requires a change in the printing plate to conform to the shape and size of the container. Hence, the design requires continuous maintenance resulting in delays in manufacturing as plates are repeatedly replaced with new plates in preparation for each new print job.

Another relevant reference may be found in published application No. PCT/US2015/055691 along with issued U.S. Pat. Nos. 9,550,372 and 9,327,493 to inventor Vella and applicant Stolle Machinery Company (hereinafter "Stolle"). The Stolle machine disclosed in these references provides a mandrel based turret assembly having a plurality of mandrels extending radially from the turret center hub within the plane of rotation of the turret assembly. Each mandrel is rotated by a hub driven gear assembly having a spindle driven by the hub gear; assembly and a spindle body is supported by the spindle that is inserted into the container to which an ink image is to be applied. The spindle body is sized to support and lock each container in place from within the container. Each spindle, spindle body, and each container rotate together as the turret rotates and travel through a series of ink stations for applying and drying ink applied onto the surface of a container held by each mandrel.

The above Stolle configuration as well as others similar in the art have several disadvantages. First, the current Stolle design uses a central hub positioned, single transmission gear to drive all spindle bodies simultaneously at a constant rotational rate. This puts strain on the central gear hub leading to increased wear and reduction in gear life. Further, each element in the rotation transmission of such a system is subject to wear and tear causing greater maintenance costs for any machine. Moreover, all linked elements of the system rotate at the same rate. Thus, for example, the various mandrels of each print stations rotate when the turret rotates, even if no cans are being decorated as for example during container loading of the system. This causes additional wear where none need be encountered.

Furthermore, all spindle bodies, and therefore each container, maintain a simultaneous rotational speed at ink stations as ink is applied to the container. This limits the amount of ink that can be varied over the surface and limits the inking time at a particular position on the surface of the container. A superior inking method would allow for each ink station to be able to independently control rotation and ink deposition to best suit the particular ink and design to be applied. Moreover, rotational speed, and thereby production throughput, is limited by the slowest required rotational speed at any particular station in the entire system. Hence, production speed is unnecessarily limited, and ink deposition not optimized.

Production throughput is further limited during loading and unloading of media in the Stolle and similar designs. In order for an undecorated media article or a decorated media article to be loaded or unloaded from a machine, the spindles must be stopped. Since each spindle is centrally and dependently driving from the central hub, this requires that all spindles stop around the entire turret during a decorating job. This design limitation further complicates a decorating run and limits throughput because of the delay caused for stopping and re-starting the rotation of each spindle on the machine.

Another limitation of the above designs is that each spindle body supporting must be specially designed for each container. Each spindle body (e.g. mandrel elements 26 and 60 of the Stolle design; see FIG. 5) is a complicated device that engages and secures each container through a combination of hydraulic and air pressure control elements. Hence, each spindle body and the spindle that supports it must be removed and replaced for each container, thereby causing the delay and stopping of a production line for an extended period of time, as well as the expensive and complicated reproduction of a suitable spindle body. Also, recalibration of the entire machine must be done for each spindle change. In other words, spindle based systems as per above are not modular, but essentially cause the rebuilding of a machine around a reconfigured spindle for each new container shape or size to be processed.

As may be understood from the above described function of each spindle body, such a system is limited by the shape and size of each spindle body so that only a limited range of containers may be decorated. For example, slender e.g. less than 0.5 inches in diameter container like a lipstick container body cannot be decorated by the spindle based holding system.

The Stolle and other designs have a further limitations namely, each print head assembly is custom designed for each ink station configuration, including a custom sized support assembly member (e.g. element 108 in the Stolle design) supported by a machine frame support surface (e.g. bays 44 and deck surface 39 in the Stolle design). Since the size, shape, and resolution compatibility of each print head assembly defines the types of container designs that may be printed, and the size and shape of the surface on a container onto which such design may be applied, such a non-modular print head design limits the types of containers onto which designs may be printed. Further, while Stolle discloses radially positioned ink heads around the spindle body radius (e.g. FIGS. 9-12 of Stolle), Stolle does not disclose the longitudinal arrangement of multiple print heads positioned parallel to the spindle body axis of rotation. This is because Stolle is limited to a track-based radially positioned assembly (106; FIG. 7) that prohibits the longitudinal positioning of a plurality of print heads side by side (e.g. see FIGS. 7-8, elements 106, 120). Hence, the Stolle print head design limits the coverage of the digital print head 122 (FIG. 8) over a container requiring a plurality of container rotations in order for a single print head to print a design over the entire surface of a container, thereby requiring more time for each container to be at each print station during production than would be necessary if a single print head design could accommodate various container designs.

There is, therefore, a number of improvements that may be made to the current designs in the container print industry to improve the speed of container decorating process and reduce the processing cost of both manufacturing assembly and the cost of process production.

SUMMARY OF THE INVENTION

The invention is a method of using a turret styled decorator machine to decorate container media. The machine utilized has a rotatable turret and a number of circumferentially spaced container holding assemblies for holding a variety of pieces of "media," such as a drink container, the exterior surface of which is to have ink applied to form an image. A plurality of workstations are positioned around the perimeter of the turret through which each media holder passes as the turret rotates. Loaded container media is moved through the workstations, paused, and ink is applied with a printing assembly and ink partially cured using a curing assembly so that ink may be applied and partially cured as each piece of media is indexed into each new workstation location. Due to the unique configuration of the decorating machine, each piece of media, once loaded, spins at a rate different from any other piece of media so that the entire decorating process is speed optimized for each print job. Further, container media may spin continuously during the decorating process so that the turret never needs to pause for media to stop rotating or to begin rotating.

Other features and objects and advantages of the present invention will become apparent from a reading of the following description as well as a study of the appended drawings.

BRIEF DESCRIPTION OF THE DRAWINGS

A turret styled media decorator incorporating the features of the invention is depicted in the attached drawings which form a portion of the disclosure and wherein.

DESCRIPTION OF THE PREFERRED EMBODIMENTS

Figure 1:
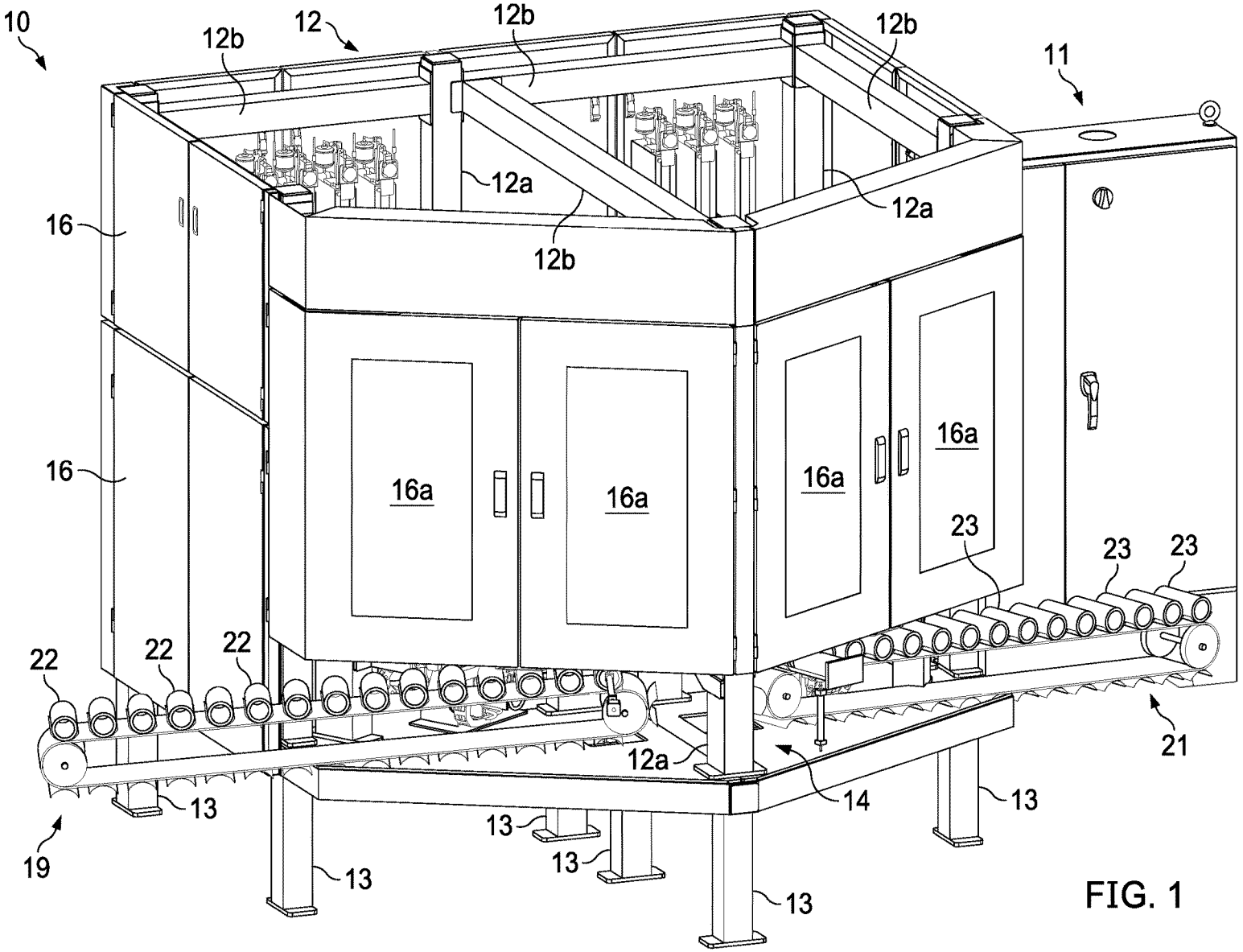
FIG. 1 a front perspective view of the decorator.
Figure 1A:
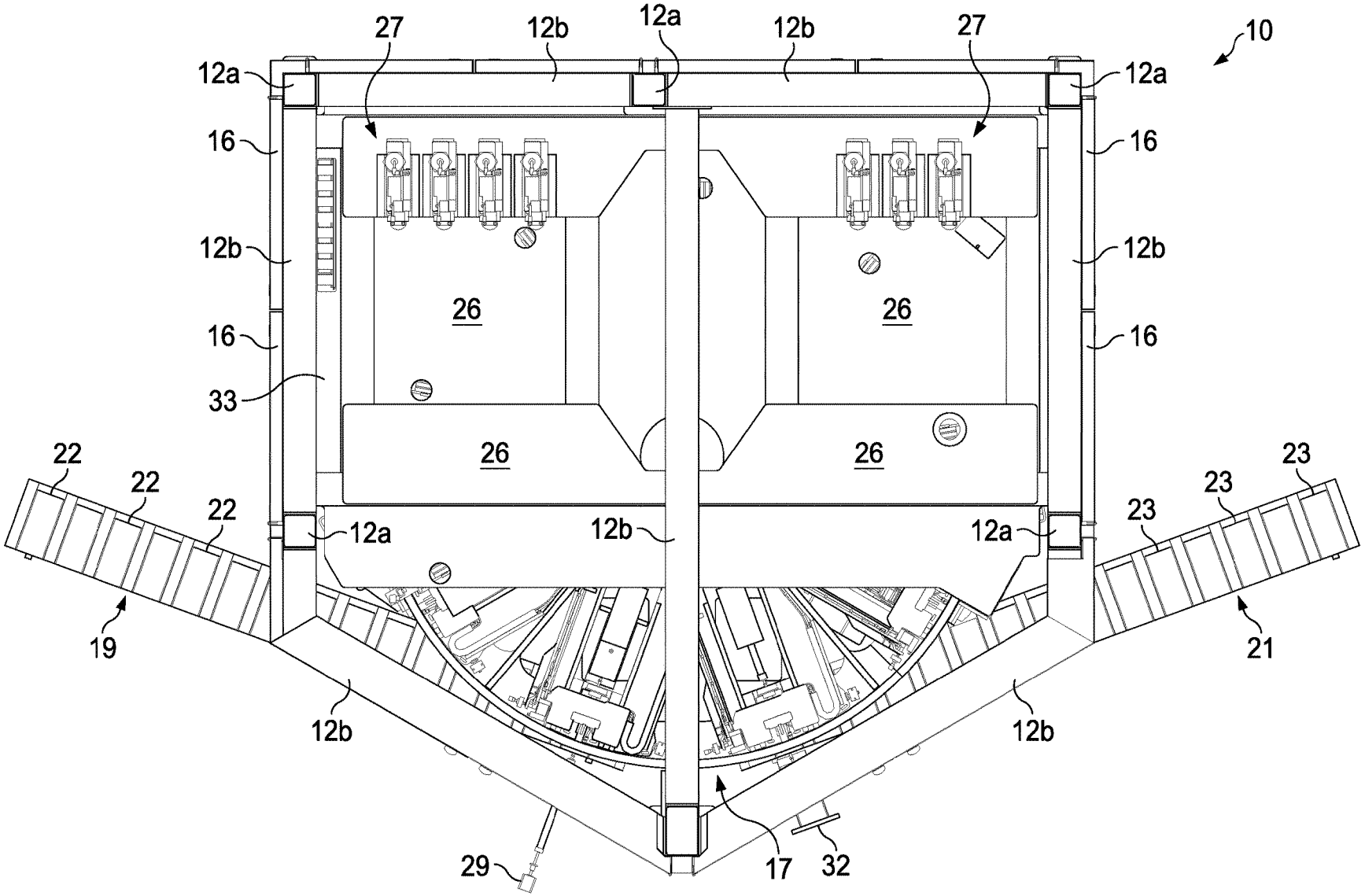
FIG. 1A is a plan view of the decorator.

Referring to the drawings for a better understanding of the function and structure of the invention, FIGS. 1-1A shows container decorator 10 is a turret styled decorating machine having a rotatable turret 17 supported by an internal support frame 12, and having vertical 12*a* and horizontal 12*b* support members enclosed by a number of exterior panels 16, some of which are openable 16*a* for servicing of the interior of the machine. Turret 17 is supported by frame members 12*a,b* and platform 14, and platform 14 is supported by a plurality of legs 13. The legs 13 extend downward from supporting platform 14 to support the overall turret decorator a predefined distance above a manufacturing floor supporting the machine 10.

At the left side of the machine 10 an integrated cabinet 33 is positioned behind a removable panel 16 that holds various inking reservoirs to supply ink to each workstation and control electronics as will be further discussed. At the right side, a power cabinet 11 is spaced apart from decorator 10, but electrically connected to it to provide conditioned power for running the decorator and providing network communications to connected computer workstations within the factory (not shown). As may be understood, cabinet 11 would also include fuses or relays for electrically isolating decorator 10 from a manufacturing power grid in a factory setting and for isolating electrical faults in the machine. Further discussion regarding power cabinet 11 shall be omitted and shall be shown in phantom, when needed, since such electrical enclosures are well understood and not necessary for a complete understanding of the herein described invention.

A loading conveyor subsystem 19 is positioned on the left side of decorator 10, adjacent and beneath panel door 16*a* for the automatic loading of undecorated or "blank" container articles 22. Similarly, at the right side, an unloading conveyor subsystem 21 is positioned to deliver decorated articles 23 to other parts of a factory in which decorator 10 may be situated. The terms "articles," "media," and "media articles" are used synonymously herein and refer to containers upon which the decorator machine 10 imparts ink designs transitioning them from an undecorated state to a decorated state, or in between, depending upon the location of the media within machine 10.

FIG. 1A shows the top portion of the machine 10 having an upper enclosure platform 26 and supporting a plurality of ink tanks 27 above turret 17 to supply ink to each workstation. As shown, each conveyor assembly 19,21 is positioned to present a sequenced and continuous stream of undecorated container articles to machine 10 and to remove decorated articles therefrom. A pushrod 29 is actuated from an external servo (not shown) to push an undecorated article 22 into the machine for processing in a timed fashion, and an retractor 32 removes decorated articles 23 from the machine 10 onto unloading conveyor 21 after passing the last processing workstation.

Figure 2:
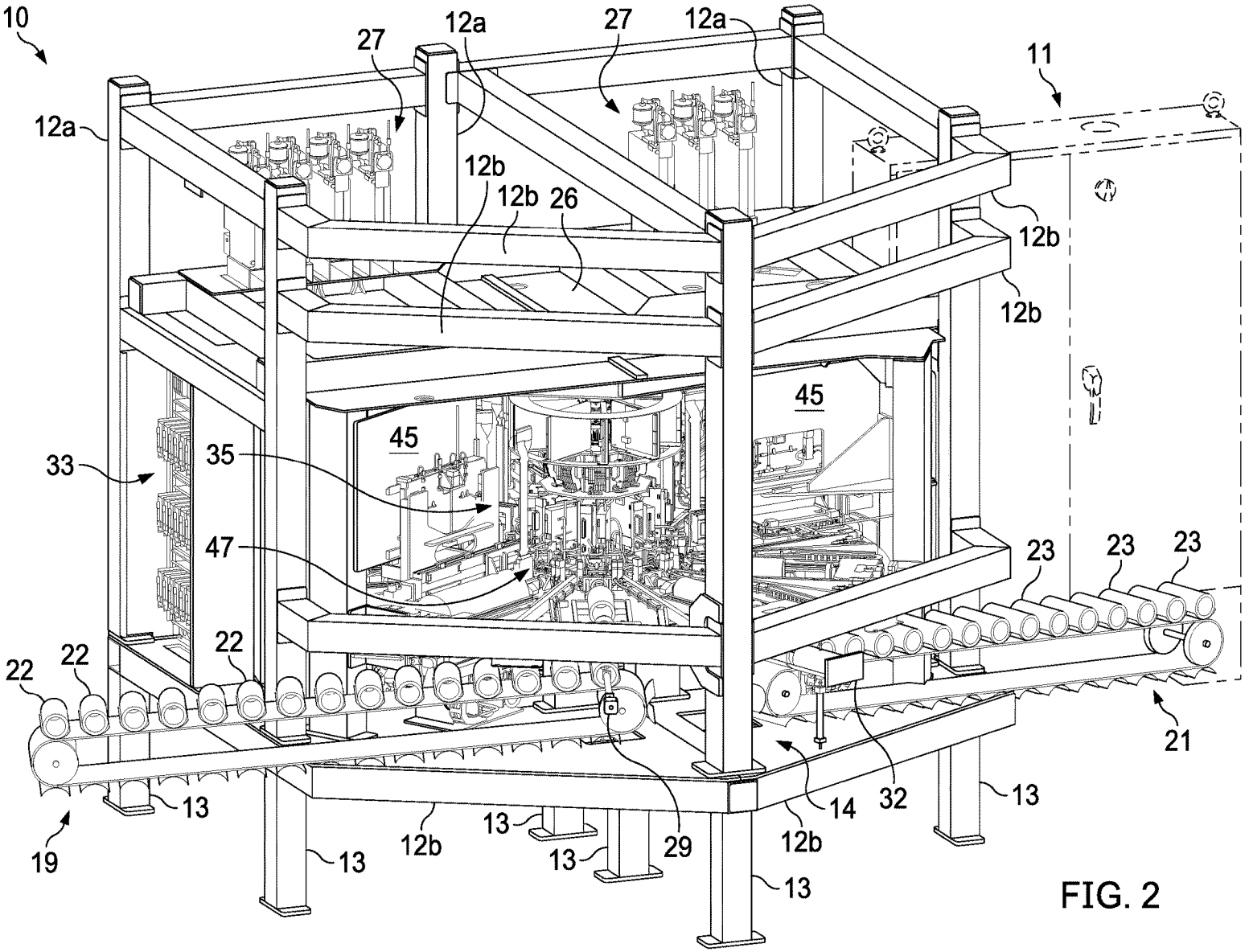
FIG. 2 is a front perspective view of the decorator with its cabinet doors and exterior casing removed.
Figure 3:
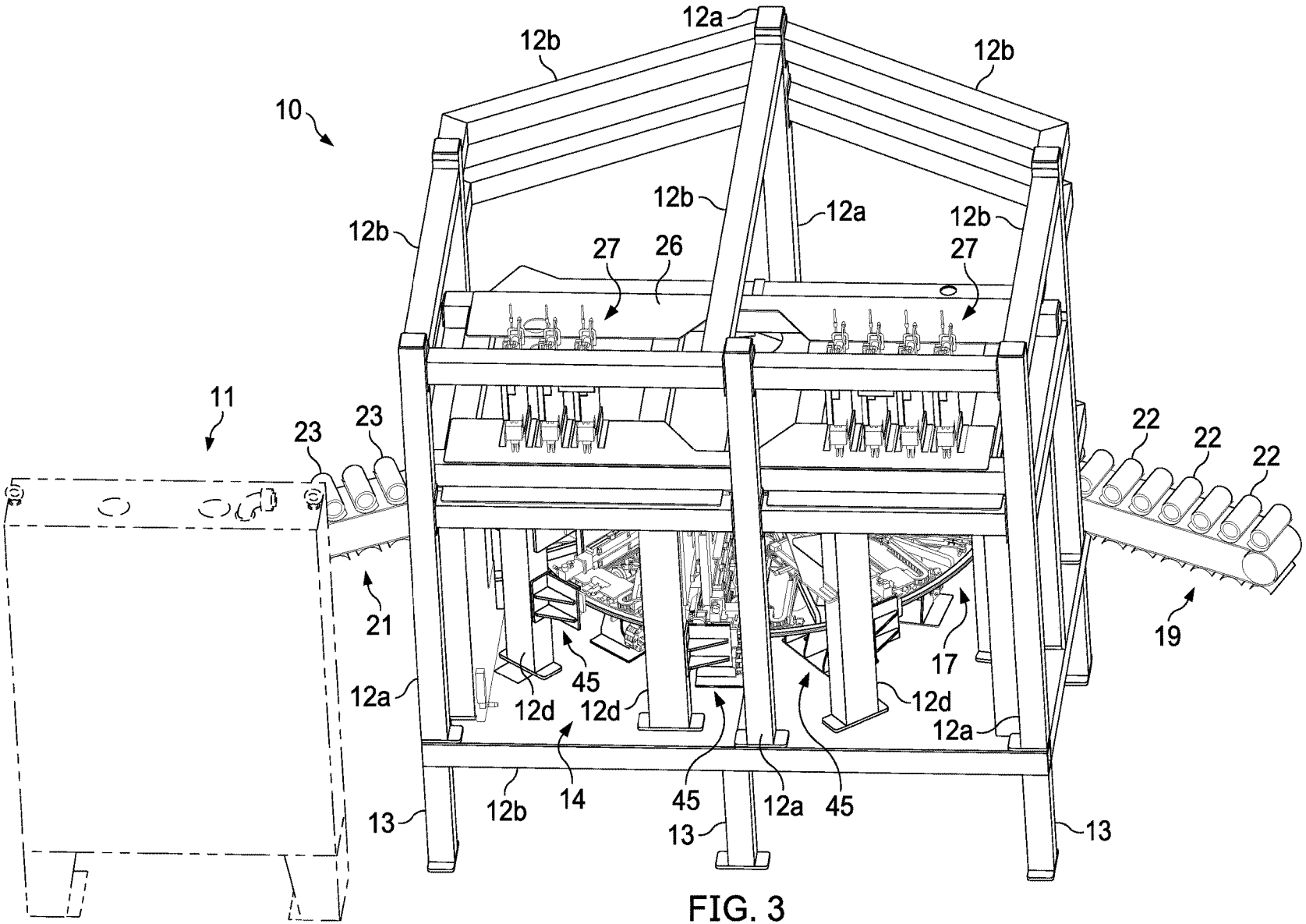
FIG. 3 is a rear perspective view of the turret type decorator with its cabinet doors and exterior casing removed.

Referring now to FIGS. 2 and 3, FIG. 2 shows decorator 10 having its external panels and casing 16 removed with the power utility cabinet 11 shown to the right of the turret decorator in phantom. Upper shelf 26 may be seen that holds various wires, circuitry, and ink delivery tubes suspended above the rotating turret and the individual workstations within the structural cabinet of the turret decorator, along with ink tanks 27. The interior 35 of machine 10 holds rotating turret 17 transiting through a series of workstations 45, and also supporting a central hub 47 for holding various elements and structures for dispersing electrical power and communication links to various operational elements held by the turret 17. The workstations 45 are generally positioned around the periphery of the rotating turret 17.

FIG. 3 shows a rear view of the machine 10 with a portion of the upper modular frame structure and rear casing structure removed. A series of workstations 45 may be seen that are supported by a set of spaced, vertical support members 12*d* affixed to and supported by platform 14. As may be seen (see FIG. 4A as well) the workstations 45 are positioned around the periphery of turret 17.

Figure 4A:
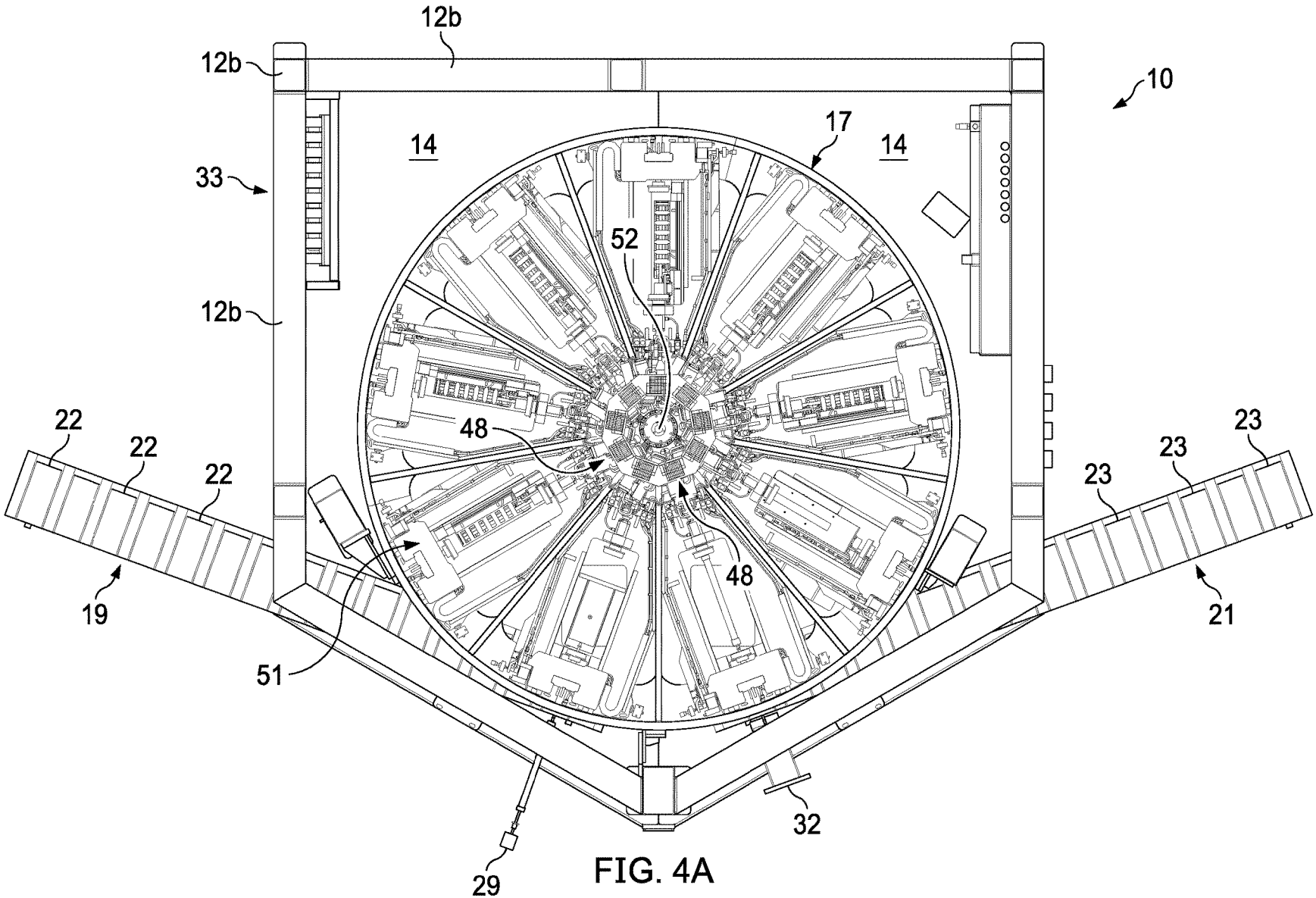
FIG. 4A is a plan view of the turret type decorator with its cabinet doors and exterior removed.
Figure 4B:
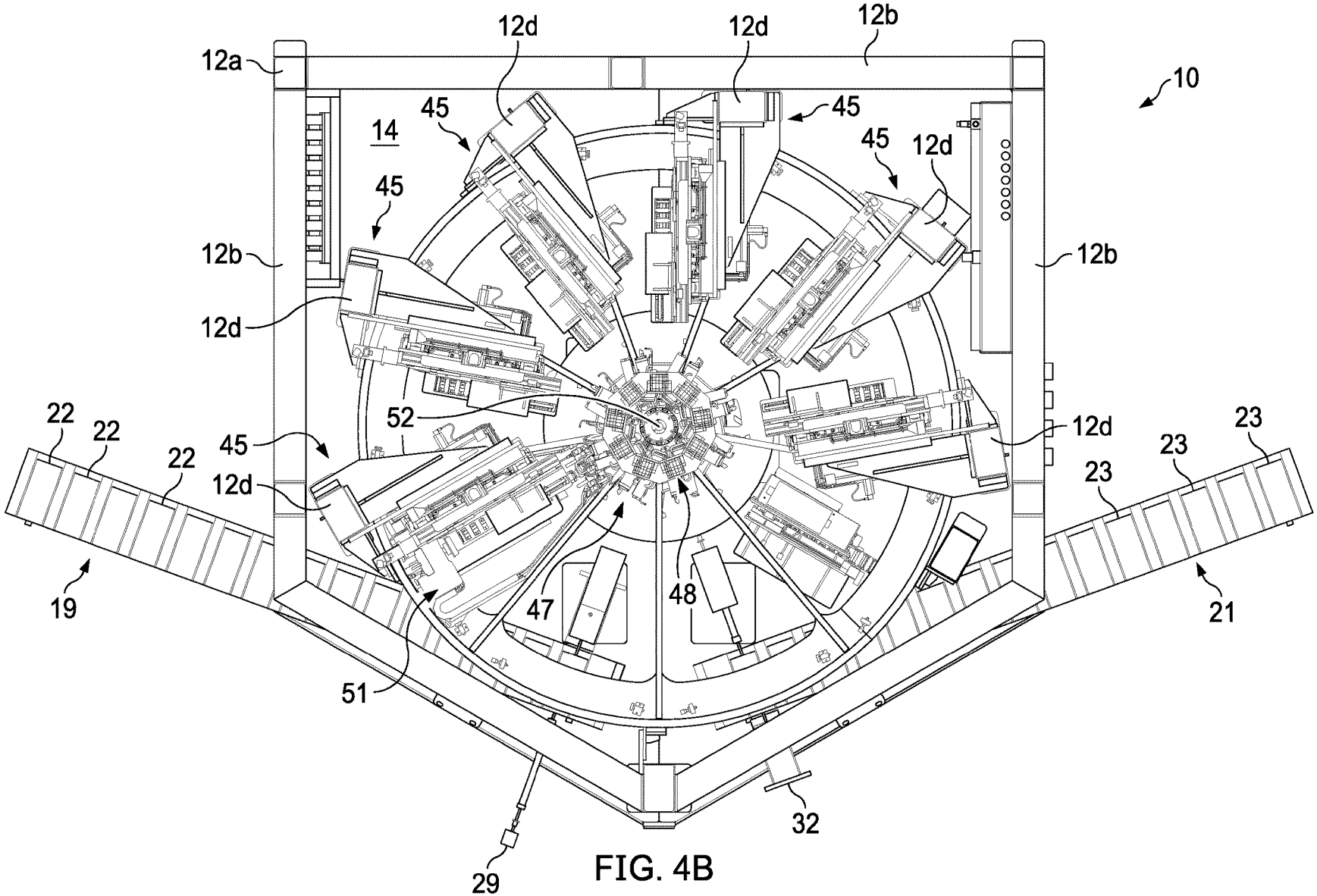
FIG. 4B is plan view of the turret type decorator with a portion of the upper structural support members removed to show the turret and workstations.

FIG. 4A has additional elements removed including the elevated platform 26 previously shown in FIG. 1A and the individual workstations 45 that are positioned around the hub 47 of turret 17. FIG. 4B adds back into the view the workstations 45 thereby showing their positioning in the machine 10 relative to the turret 17. In the shown exemplary embodiment, 7 workstations are shown for printing on media in addition to 2 ingress and egress workstations for a total of 9 workstations. Hence, machine 10 has 2 loading workstations and 7 print workstations where, potentially, 1 of those print workstations might be dedicated to curing only. The turret hub 47 includes a rotary assembly 48 as shown that supports the electrical connectors on the central hub 47 as well as supporting a series of media holding means 51 as will be further described. The rotary assembly 48 is supported by and surrounds a central shaft 52 that forms the center of the rotating turret 17. The shaft also corresponds with a central, rotation vertical axis 53 for turret 17 during rotation.

Figure 5:
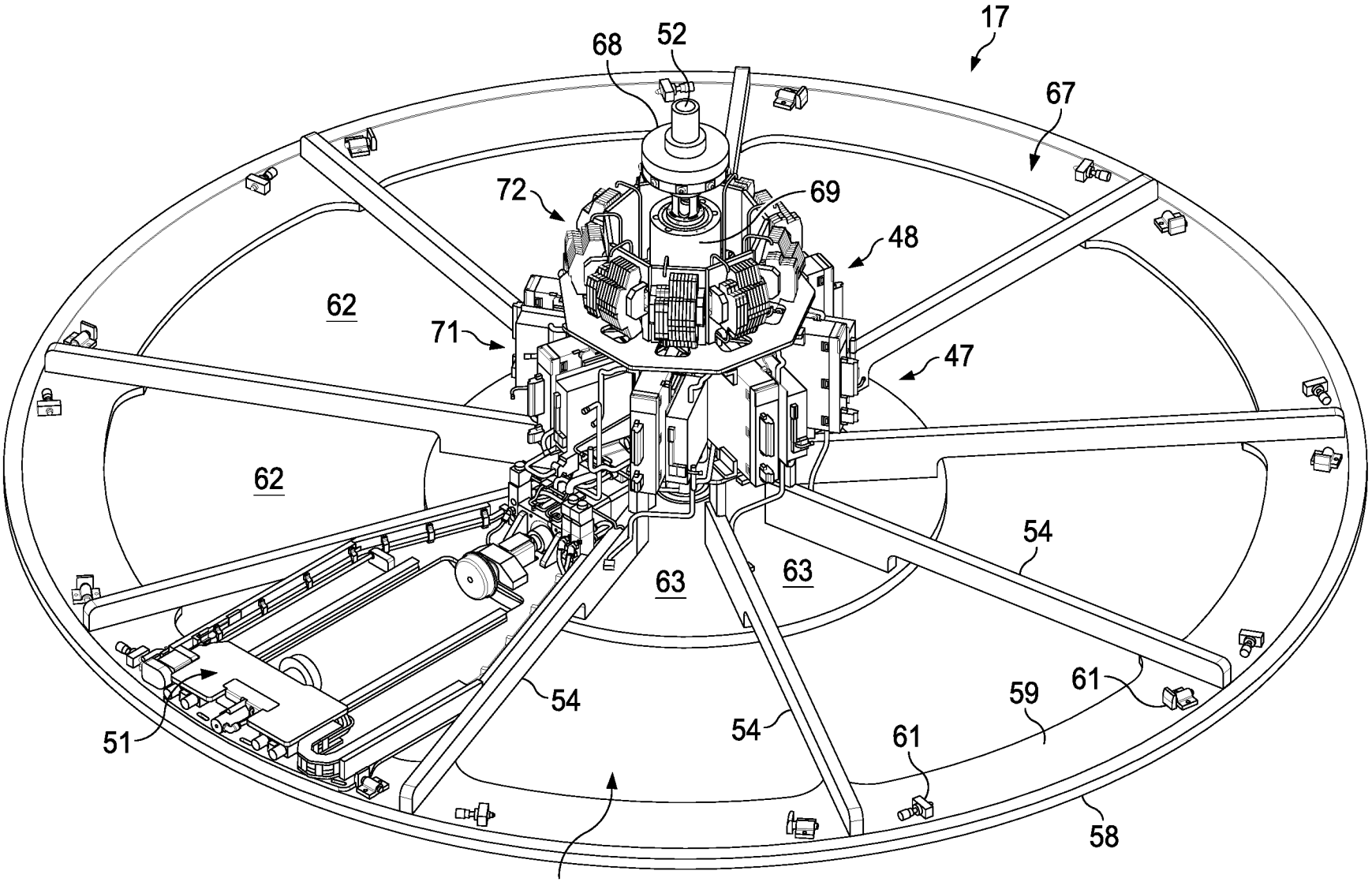
FIG. 5 is an isolated perspective view of the turret populated with a single media holding means in one of the pie-shaped sections.
Figure 6:
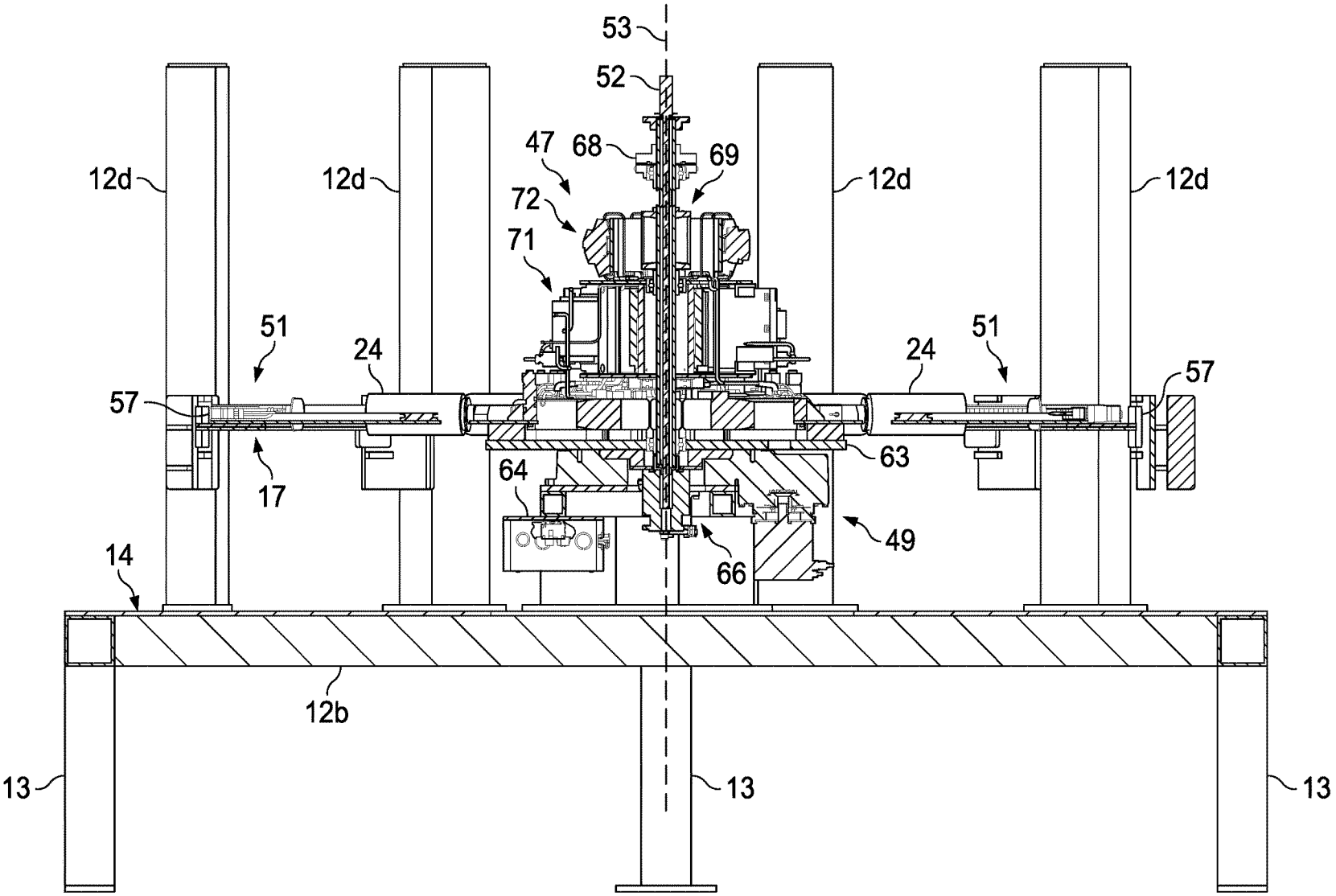
FIG. 6 is a sectional view of the turret shown in FIG. 5 and showing the support and drive structures when positioned within the decorator.

Referring now to FIGS. 5 and 6, the rotatable turret 17 supports rotary assembly 48 and a rotary drive mount assembly 49 supporting the rotary assembly 48 below rotary baseplate 63. A series of spoke or rib members 54 extend outward from the rotary baseplate 63 and support a rotary ring assembly 67 forming the circumference of the turret 17. The ring assembly includes an outer flat rim 58 supporting an outer circumferential flange 59 extending inward to form an outer, circular margin or shelf. A plurality of track followers 57 are positioned on the support member 12*d* that engage outer rim 58 to assist in stabilizing and supporting turret 17 during rotation. Outer shelf 59 supports a pair of bolt clamps 61 for affixing a distal portion of a media holding means 51 to the turret 17. The outer rim 58, hub 47, and ribs 54 define a plurality of pie-shaped wedges 56, each cooperatively sized to support media holding means 51 in each wedge section 56. The interior 62 of each wedge 56 is hollow to reduce the weight of the turret 17.

Rotary drive mount assembly 49 is supported by platform 14 to which it is statically affixed. Assembly 49 includes bearing support assembly 66 to rotationally support shaft 52 and rotary baseplate 63, with shaft 52 is rotationally engaged to a movement means 64, such as an electrically controlled motor or actuator, with an attached ring gear that allows for precise indexing of the turret 17 to preprogrammed workstation locations around its central rotational axis 53. Movement of the motor is controlled with a pre-programed motion controller on the machine and uses an internal EtherCAT network link to transfer motion commands from the motion controller to motor 64. Motion control programming and index control is downloaded into the motion controller from a workstation connected to the machine via standard ethernet communications lines from the factory floor. As may be understood, rotary drive mount 49 assembly includes indexing sensors to record the angular position of the turret 17 so that media indexing from one workstation to another is precisely controlled. While not shown, an upper portion of shaft 52 may also be supported by a bearing 68 supported by upper shelf 26 to increase shaft stability. Positioned above and supported by rotary baseplate 63 are the rotary assembly 48, an actuator and connector assembly 71, and a servo drive assembly 72 that supports a plurality of servo drives and stepper drives for electrically driving media clamping and rotation for print media while being held in the media holder 51. Communications of drive signals and power to each drive from the motion controller is provided through a slip ring assembly 69 surrounding shaft 52. Connector assembly 72 holds electrical and data connections dedicated to each pie section 56 for all servo drives and which are connected to the motion controller in enclosure 33 through the slip ring assembly 69. The positioning of each servo drive unit dedicated to each pie section 56 on the turret 17 allows for the independent control of servos that control the movement of media during printing relative to other pieces of media loaded into other media holding means 51 in other pie sections 56.

Figure 7A:
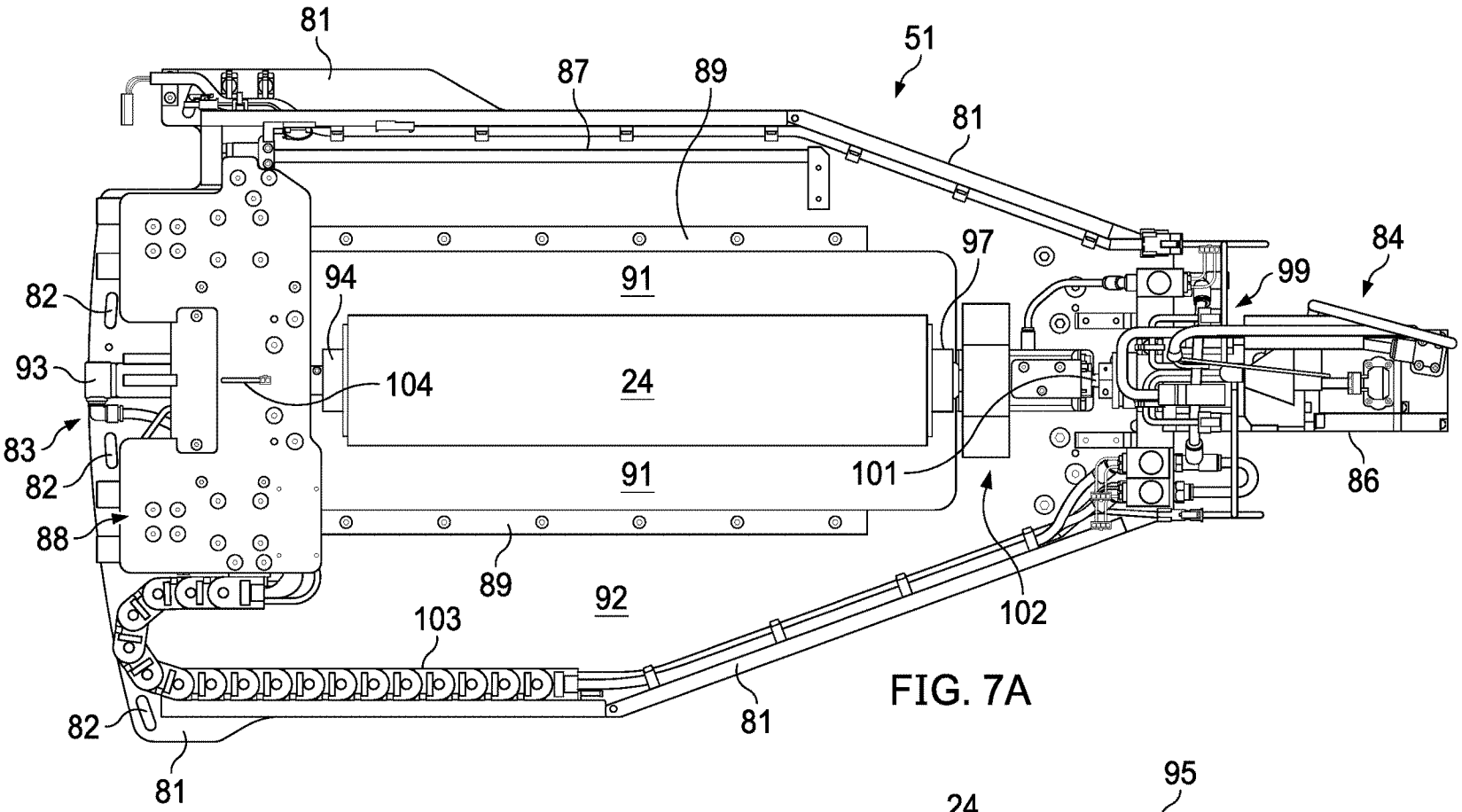
FIG. 7A is an enlarged plan view of a media holding means removed from the turret of FIG. 5.
Figure 7B:
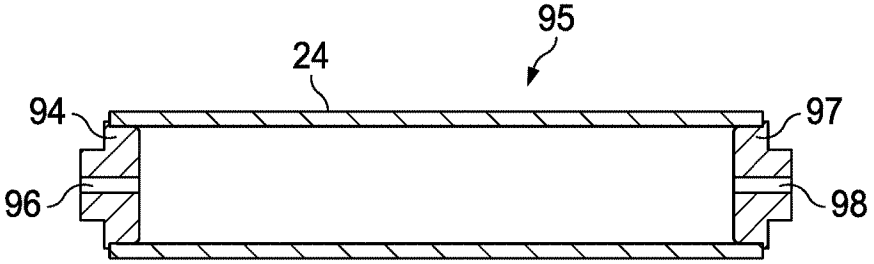
FIG. 7B is an inset, section view of a piece of media showing the placement of end stocks to hold the media during printing.

Referring now to FIGS. 7A and 7B, a media holding means or "media carriage" 51 is shown having a frame 81 and an interior deck or table 92 defining a void 91 across which spans a clamped piece of media 24 for printing. Frame 81 is supported by and held in place within pie section 56 via bolt clamps 61 at apertures 82 at distal end 83, and via bolts that hold support member 86 at proximal end 84 on rotary baseplate 63. Deck 92 supports a carriage assembly 88 and a pair of fastener apertures 82 at distal end 83. Carriage assembly 88 rests on and is extendable along rails 89 from distal end 83 toward proximal end 84 via an actuator within carriage assembly 88. Actuator is functionally connected to a rod 87 causing movement of carriage assembly 88 along rod 87 and, therefore, rails 89, with an articulating cable carrier 103 moving with the carriage 88 so that the carriage is electrically connected to the machine motion controller. Carriage assembly 88 includes a brake (not shown) that fixes its position along rails 89 after being moved into position.

Media 24 is held in place across void 91 by a pair of end stocks 94 and 97 that are fitted to the ends of the media 24 as shown. Proximal end stock 97 is axially fixed, but distal end stock 94 is axially movable from a unlocked position to a locked position via a rotatable shaft 104 extending from an air cylinder 93 that biases the shaft within aperture 96 against end stock 94. Once carriage assembly 88 is positioned near media 24 and locked in place, air cylinder rod 104 extends against fitted end stock 94 to bias it against media 24, thereby locking the media 24 in place against proximal fitted end stock 97 to form a media/end stock combination 95 (FIG. 7B). Proximal end stock 97 is supported by a shaft 101 extending into end stock aperture 98 which is press fitted so that the end stock 97 and shaft 101 are rotationally fixed. Shaft 101 is rotatably supported by bearing support assembly 102 and extends into a servo motor assembly 99 having a servo motor electrically driven by a drive controller positioned in drive assembly 71 and controlled by the motion controller. Servo assembly 99 includes an optical encoder and a home sensor so that precise control over the position of media 24 is maintained during rotation of end stock 97 via the servo motor.

It is contemplated that each end stock will be self aligning and self stripping, so that each end stock may be interchangeable for different types of media geometries. Hence, an operator may position the carriage assembly 88 to accommodate differing sizes of media 24 with the actuated air cylinder 93 engaged to rotatably affix media 24 within the media holder 51. The above arrangement permits the rapid, electrically controlled locking and release of media in a timed manner. Further, once the media holding means 51 is sized with end stocks, a piece of media may be loaded and unloaded from each media holding means quickly at a predetermined index location within the rotational sweep of rotating turret 18.

Since the end fixtures 94,97 are passive elements, the exchange or swapping of the end fixtures is a relatively simple and inexpensive activity that allows for the rapid preparation of the turret decorator for a new size of media. As shown, each end stock is retained within each media holding means 51 so that as each media 24 is loaded into a media holding means 51 the end stocks are reused for each piece of media as it rotates through the series of workstations 45 on the system.

Figure 8:
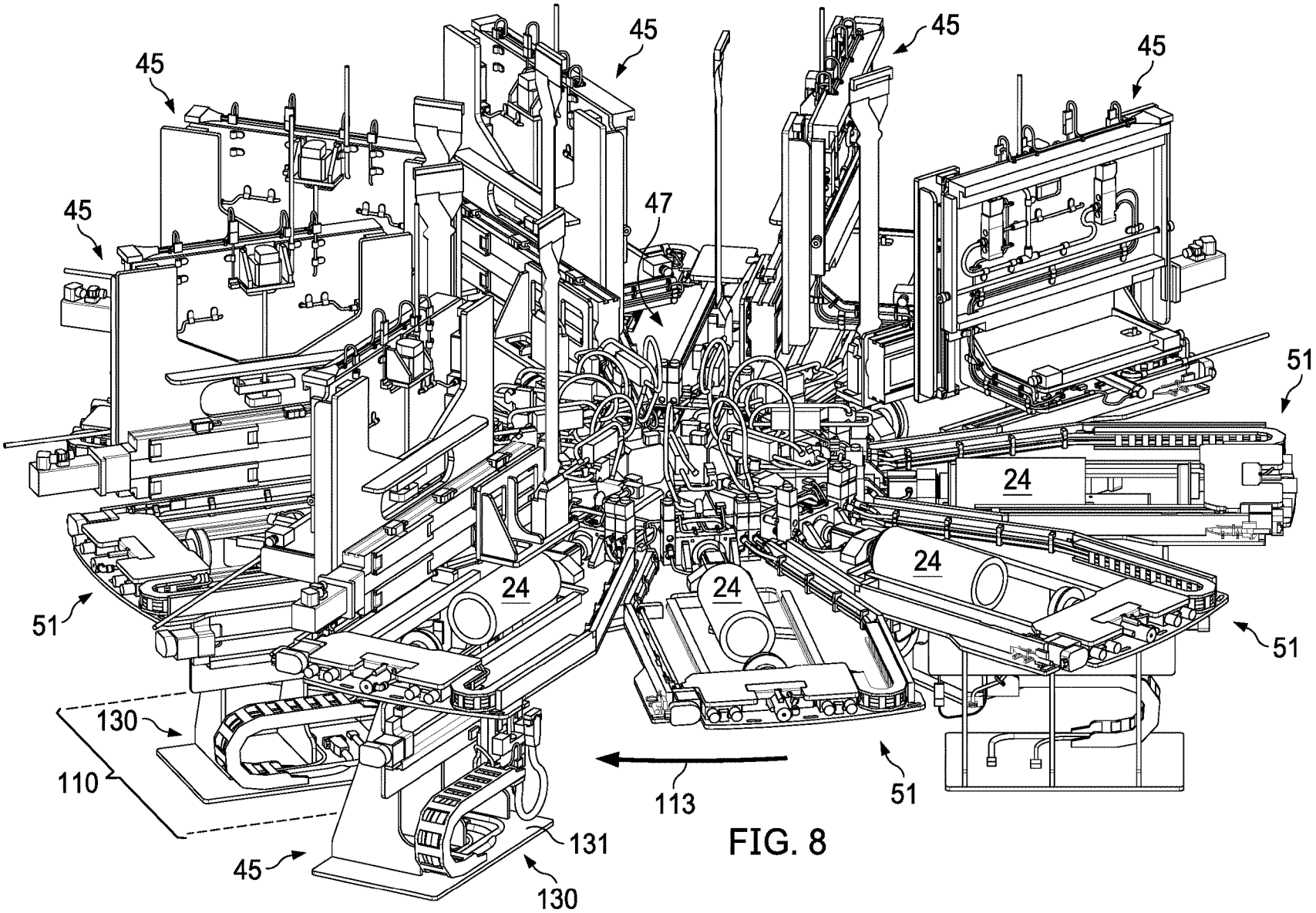
FIG. 8 is a perspective view of the collection of workstations through which the media holding means of the turret of FIGS. 5 and 6 passes during rotation.
Figure 9:
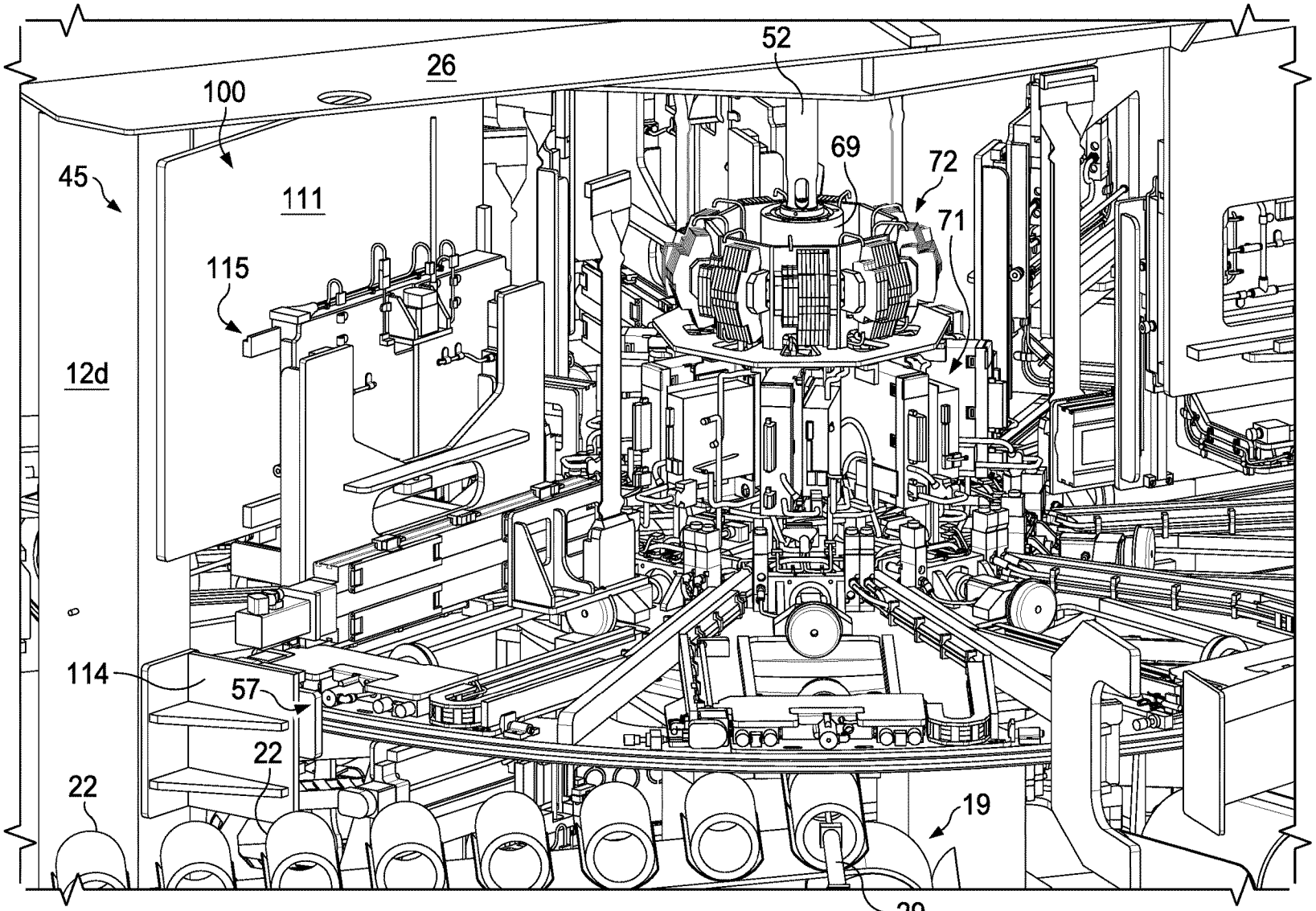
FIG. 9 is an enlarged perspective view from FIG. 2 showing a workstation holding a printing assembly.

Referring now to FIGS. 8-9 it may be seen the positioning of each workstation 45 relative to hub 47. A support plate 111 is rigidly affixed through bolting or welding to vertical support member 12*d* that supports a downward depending print assembly 100. A side support member 114 extends laterally from vertical member 12*d* to support track followers 57 that in turn provide rotational support to outer rim 58. As shown, a series of holding means 51 supports pieces of media 24 in the middle of being processed and arranged to rotate clockwise 113 through a series of workstations 45. As mentioned above, 7 of the workstations are print workstations and 2 are loading and off-loading workstations. Each print workstation is bifurcated into an upper print assembly 115 and a curing assembly 130 positioned below the rotating media held in holding means 51. Curing assembly 130 is supported by a pedestal 131 which is rigidly affixed to platform 14. The curing assembly 130 may be used for fully curing a applied image or partially curing (i.e. "tacking") the image in preparation for an additional color application or design application at the next print workstation. The workstations 45 are supported by and stabilized by elements 12*d*, 111, and 131 so that the bifurcated workstation is precisely held in place as turret 17 supporting each holding means 51 within each pie section 56, along with a piece of media 24, transgresses through the middle of each workstation 45. As shown, the positioning of substantial elements of each workstation is such that the movement of a print head as will be further described is orthogonal with respect to the central vertical, rotational axis 53 of the turret 17. In other words, the central radial axis 53 of the turret 17 remains vertical as media indexes through each workstation.

The series of print workstations 45 forms a collection of uniform compartments 110 disposed generally circumferentially about, that is at least partially encircling, the turret drive assembly axis 53 of rotation 113. Further, the uniform compartments are evenly spaced about the axis of rotation 53 and are disposed at the periphery of the turret assembly 17, and enclose an outer circumferential portion of the turret assembly 17 during rotational travel. Thus, with the exception of the first and last compartments for loading and off-loading, the series of compartments 110 are disposed in series with an adjacent upstream compartment 110 positioned next to an adjacent downstream compartment 110. As used herein, the terms "upstream" and "downstream" refer to the circumferential direction of travel of each media holding means 51 held in each pie section 56. Now, within the context of its travel movement, it may be understood that each media holding means 51 effectively comprises a "decorating table" 120 for printing upon or "decorating" each piece of media 24 in sequential color phases as each decorating table moves from compartment to compartment in a clockwise movement 113. For the purposes of describing the decorating process of media 24 within machine 10, the term "decorating table" shall be used to describe the combination of the media holding means 51, which in function is a media carriage, in combination with a piece of media 24 in the process of being decorated. It should also now be appreciated that the arrangement of the media holding means 51 is such that means 51 may be easily removed and replaced within each pie section 56 by simple disconnecting a small number of electrical connectors and unbolting support member 86 and fasteners 61, thereby permitting the rapid replacement of each holding means 51 for maintenance or reconfiguring the holding means with new end stocks 94,97. Hence, in preparation for a printing run of a particular media size, and depending upon the geometric configuration of the media, a set of media holding means 51 may be preconfigured with end stocks to match an intended piece of media and each media holding means quickly replaced for the new print job, or alternatively only the end stocks within the currently loaded existing media holding means may be replaced. In either case, the configuration substantially reduces the amount of time required to configure the printing machine for a printing run of new media.

Figure 10:
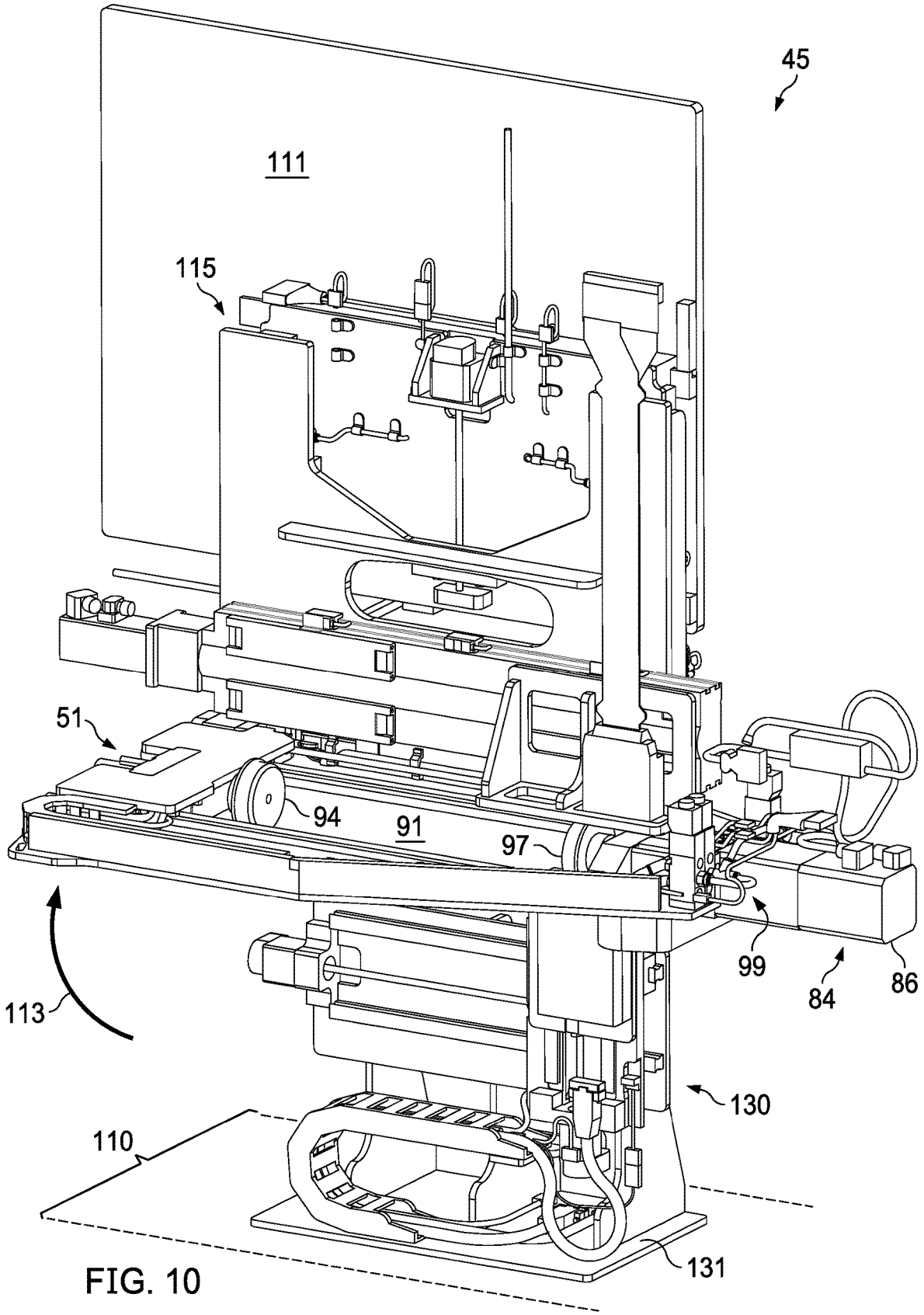
FIG. 10 is an isolated perspective view of a workstation holding having a modular printer assembly and a modular curing assembly.
Figure 11:
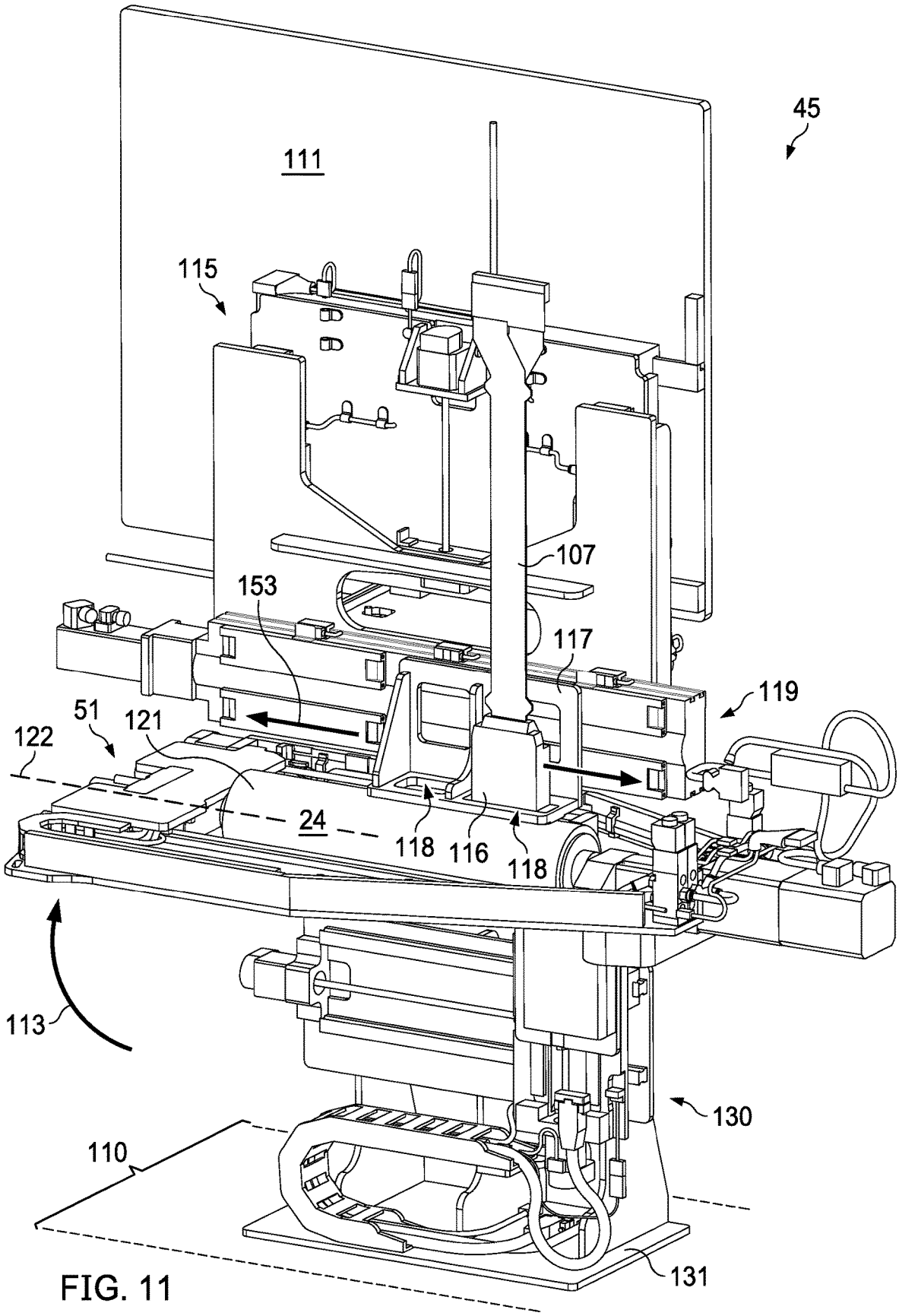
FIG. 11 is the workstation of FIG. 10 having a piece of media loaded into the media holding means with the surrounding turret structure removed.
Figure 12:
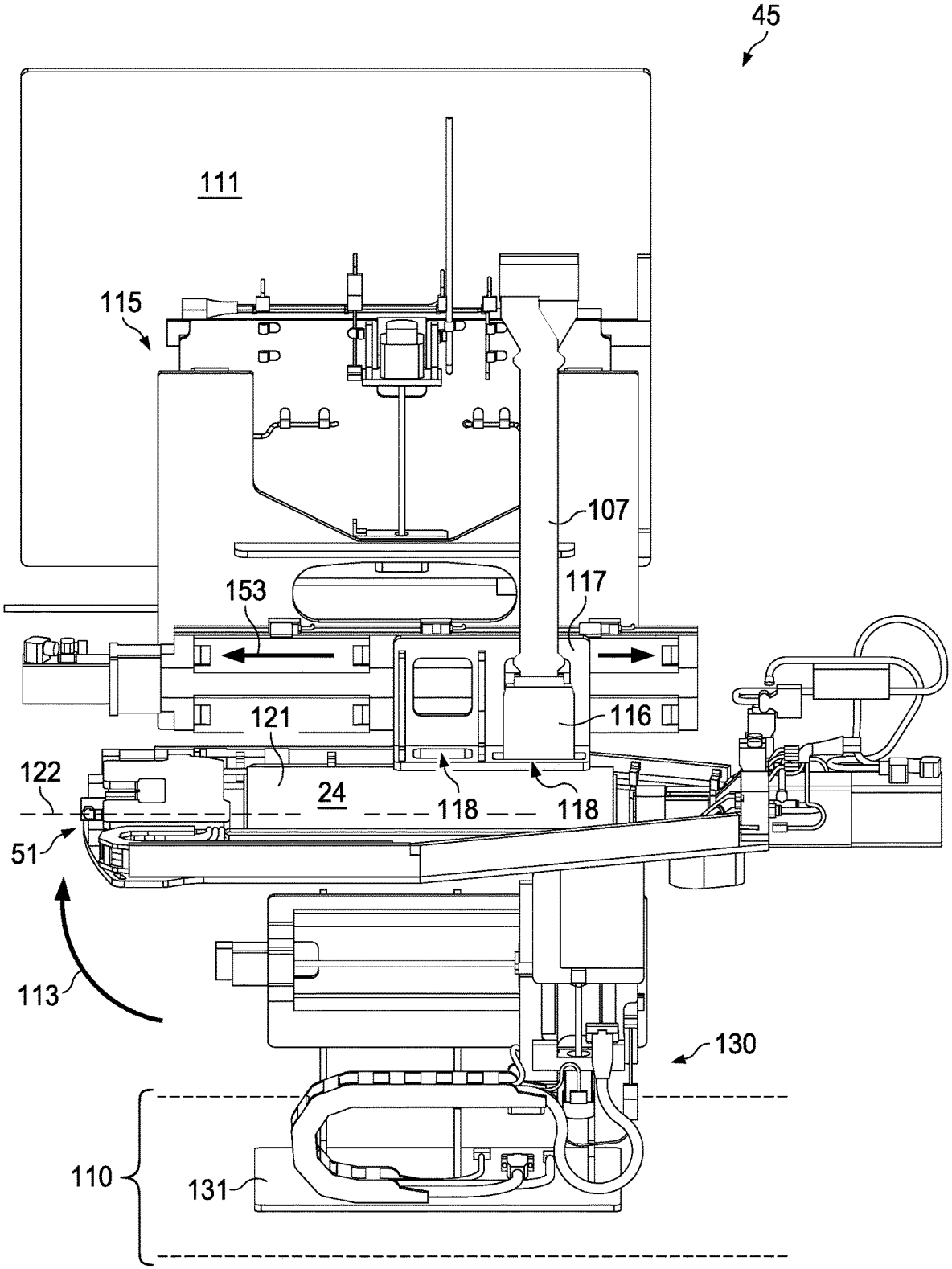
FIG. 12 is an elevational view of the workstation of FIG. 11.

Referring generally to FIGS. 10-16, each bifurcated workstation 45 may be seen in detail. Internal support 12*d* and plate 111 support print assembly 115, including a carriage print head assembly 119 holding one or more digital print heads 116, such that the digital print head and frame are modular in nature. The upper portion of the workstation shown in the figures provides passage of a portion of the rotating turret with media holding carriage 51 to pass through and beneath print head 116, so that as the turret rotates the media carriage and media 24 held therein pass underneath the print head 116. Simultaneously, the media carriage 51 passes over a cure lamp assembly 130 which is positioned below the media 24 and that allows for the passage of rays of ultraviolet radiation to be projected upon the media surface 121 as it rotates. FIGS. 11-12 show a piece of media 24 fixed to end stocks positioned within the workstation 45 with the digital print head 116 positioned above and spaced away from a the media surface a suitable distance to optimally apply a digital image through inkjet nozzles on to the media surface 121. FIGS. 10-12 show the relative positions of the holding means 51 so that the media 24 may be rotated underneath the digital print head 116 simultaneously with the controlled exposure of the ultraviolet radiation onto the media surface 121 so that applied ink may be tacked onto the surface of the media 121.

Referring specifically to FIGS. 10-12, it may be seen an isolated compartment 110 with the turret 17 removed and with a printing workstation 45 having a print assembly 115 supported by plate 111, the curing assembly 130 supported by pedestal 131, and media carriage (media holding means) 51 positioned as passing between the print assembly and curing assembly 130 in a clockwise direction 113. FIGS. 11-12 include a piece of media 24 loaded into the media carriage 51. Print head assembly 115 includes a print head 116 with connector 107 loaded into a slot 118 of a print head carriage frame 117. A second vacant slot 118 is shown that can accommodate a second print head 116, however the inventors anticipate that various carriage frame 117 designs may be incorporated to accommodate a plurality of print heads, as needed, to print on larger surfaced media and to increase printing speed through the use of simultaneous printing swaths applied across a single media surface.

Figure 13:
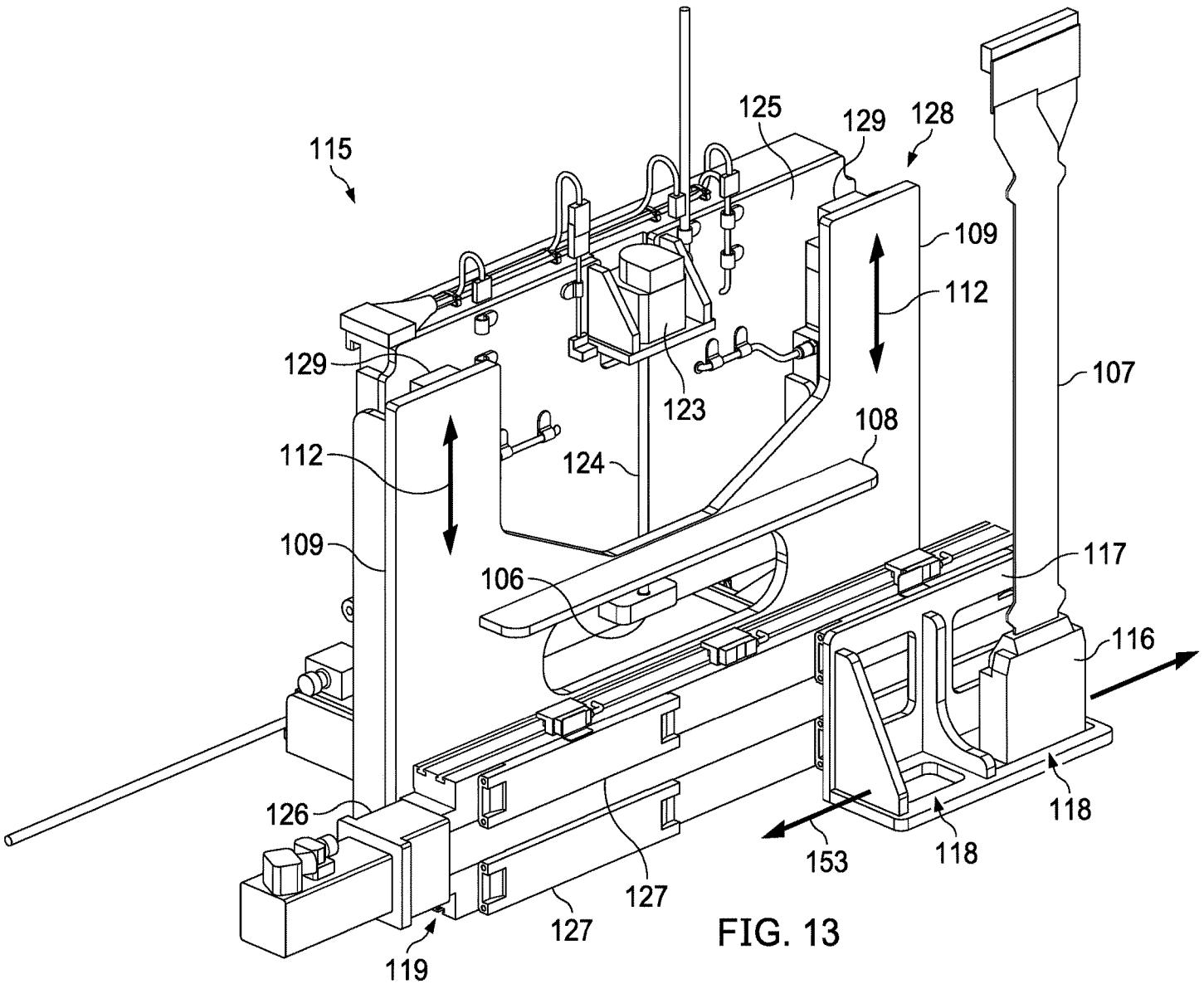
FIG. 13 is side perspective view of the modular printer assembly from the printing head side.
Figure 14:
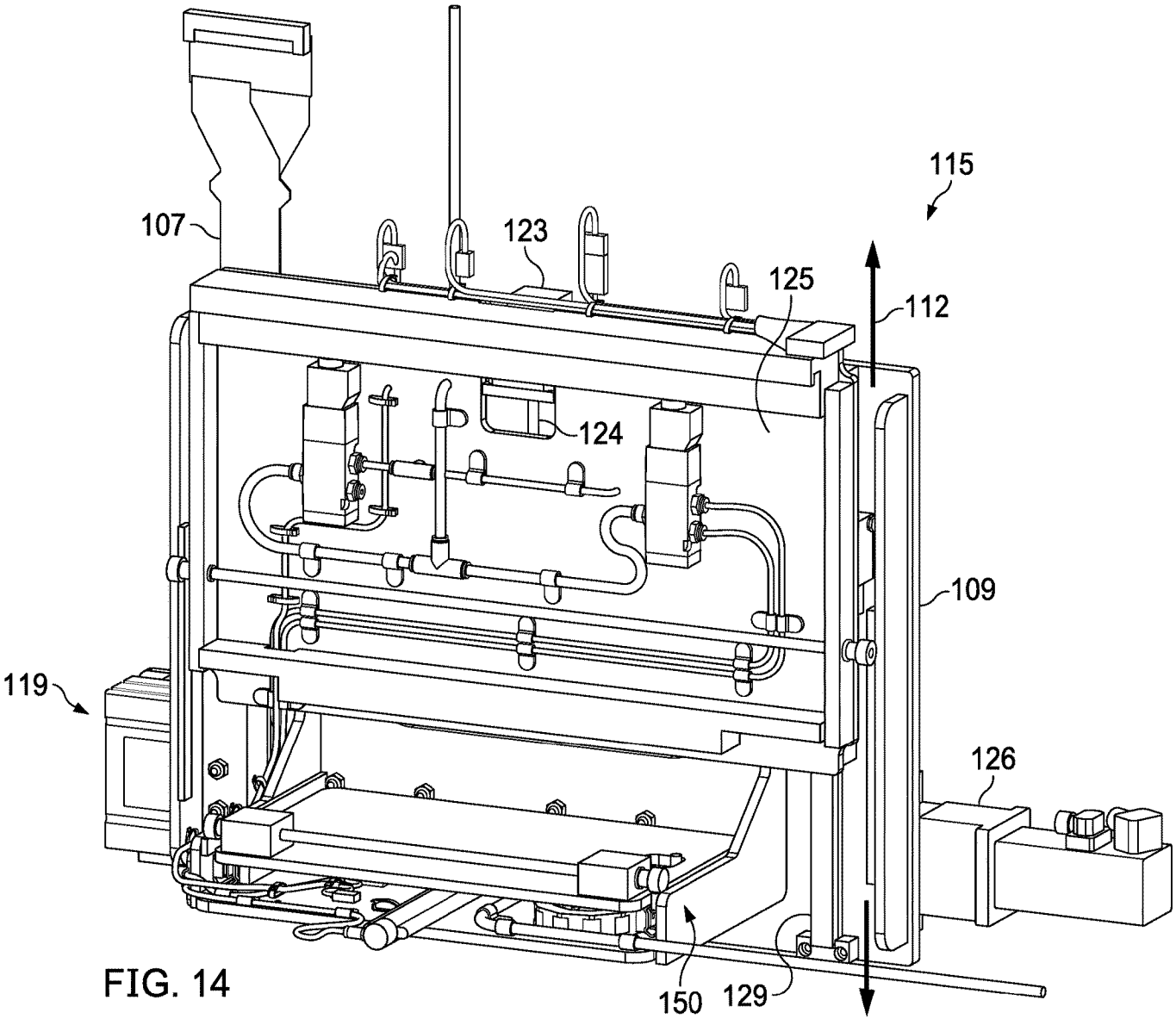
FIG. 14 is perspective view of the modular printer assembly from the side away from the printing head side.

As shown in FIGS. 13-14, carriage frame 117 is supported by a movable carriage assembly 119 that is configured to move carriage frame 117 horizontally, parallel to the axis of rotation 122 of media 24 proximal to media surface 121 along path 153 as indicated. Rails 127 are supported by and mechanically connected to an internal ball screw (not shown) and driven by a reversable motor 126. Carriage frame 117 sits upon rails 127 and is movable from a right most horizontal position to a left most horizontal position along path 153. Upon actuation, rotary motor 126 causes rails 127 to move laterally along path 153 in either direction to any preprogrammed, internally indexed lateral position. In addition, carriage assembly 119 moves in a vertical direction. Print head carriage assembly 119 is supported by a vertical carriage assembly 128 carried by a vertical support plate 125, which is in turn affixed to support plate 111 (see FIG. 9). A carriage support plate 109 rides upon a pair of vertically oriented rails 129 and is supported up and down by screw 124 connected to reversible stepper motor 123. Actuation of motor 123 causes screw 124 to rotate causing plate 109 at attachment point 106 in carriage assembly 128 to raise and lower along vertical path 112. Hence, reversable actuation of motor 123 allows for indexed movement of print head carriage frame 117 up and down to a lower extent of rails 129 up to carriage stop 108. By actuating vertical and horizontal movement means 123 and 126, print head 116 may be precisely positioned relative to media surface 121 in order that varying media geometry thicknesses may be accommodated. Each movement means 123 and 126 are internally indexed to allow for precision control of the distance between the printing head nozzles and the media surface 121. As may be understood, precise control over both the vertical height and lateral position of print head 116 allows print assembly 115 to potentially print over angled or contoured media surfaces if frame 117 is fitted with means for angling carriage orientation simultaneously with lateral and vertical adjustments.

Machine 10 includes an installed ink supply subsystem purchased from INX International, referred to herein as an "ink delivery system." For the machine to print images onto the surface 121 of a container 24, each print head 116 requires a reservoir of ink be connected with each print head to deliver the ink upon demand through each print head micro-nozzle. Hence, as is known in the industry, the ink delivery system provides a static vacuum to a series of ink supply lines from large ink reservoirs (not shown) held above the print stations supported by platform 26. Supply tanks 27 (see FIG. 2) supply through a network of supply lines (not shown) ink via a pumping system (not shown) to each print head 116. Electronics held in bay 33 control vacuum pressure in the ink lines to cause the delivery of ink from ancillary ink reservoirs to tanks 27, and also to print heads 72 via the system of tubes. Each tank also has its own pressure line via one of a series of manifold fittings that forces ink from each to the print head 116, as is known. Depending upon the type of ink used, the altitude of the manufacturing floor, and the applicable weather, a static pressure value is established to ensure that ink delivered to each print head 116 will flow freely, but not weep from the print heads when not activated. The ink control system (not shown) maintains the optimal pressure settings in memory with such "at rest" pressure in mBar being determined at a print head the home position via calibration testing that ensures the heads do not weep. Based on the density of each respective ink used, pressure values are calculated in mBar based on an ink's specific gravity. This information is communicated via a USB bus connected to the ink delivery (e.g. an JetINX's ink delivery system) at the start of each print job.

A maintenance tray is optionally incorporated into print assembly 115 via a maintenance tray assembly 150. A maintenance tray (not shown) may be positioned below print head 116 and held in place by a pair of retractable support rails (not shown) supported by and controlled by each print workstation so that when printing occurs the maintenance tray is moved out of the way of media 24 held by the media carriage 51. The maintenance tray may be extended using an air cylinder to move it into position below the print head 116, mainly during maintenance of the ink supply connections, and does not contact nor interfere with the movement of print head nor any elements of its carriage support elements. For example, while an optimal at rest print head static pressure is being adjusted for an installed ink, some weepage may occur and the presence of a maintenance tray below an ink head protects the underlying cure lamp system from the spattering of ink as well as the rest of the interior of the machine 10.

Hence, it may be understood that a print station 45 is configured so that the print assembly 115 may immediately accommodate various sizes of media geometries by simply swapping out end stocks in each media carriage 51 to be sized for a targeted media and the media carriage assembly adjusted into a position appropriate for the length of media to be held. The program position of the ink head 116 during printing and the spin rotation via servo assembly 99 is then updated in control software, such as with a new print profile, to accommodate the new media and new print job. If for some reason the print assembly 115 cannot accommodate a particular media geometry, new print heads and/or print frames may be added or swapped out rapidly, and control software in the motion controller may be reconfigured to more fully accommodate various ranges of sizes of media. FIG. 14 shows the rear side of the print assembly 115 with its solenoid valve cables and connectors that support the printhead 116 and which are designed to support such various reconfigurations without the need for reconfiguring these existing cables and source connectors.

It is important to understand that since each media carriage 51 includes a separately controlled servo drive unit in a drive unit assembly 71, the servo 99 that spins the headstocks in each holding means 51 operates independently of any other servo drive associated with any other holding means. This enables each media axis 122 to rotate independently of every other media axis so that the rotation of each media at a workstation 45 may be controlled independently from the rotation of any other piece of media at a workstation so that the application of images and the curing thereof maybe optimized to suit the type of image being applied and the type of ink being utilized at that particular station. Further, each print workstation 45 includes a separate independently controlled carriage assembly 119 with a separately controlled ink head. This allows for optimization of each workstation printing and curing so that the overall production and rotational speed of the turret may be optimized because the limiting processing step in the production of the system 10 is the longest printing and curing time elapsed at any particular station. Any particular print station 45 may be optimized to reduce the time of printing at that workstation by having the workstation 45 to be configured to meet that particular speed requirement. For example, the number of print heads 116, the shape of the print head frame 117, and the number of print head slots 118 may be varied independently from any other workstation to reduce the print time of a limiting printing process step at that particular print station 45. In addition, the time, resolution, image size, overlay of multiple colors, etc. may be varied in a container print profile so that overall printing time through machine 10 may be optimized such that a single workstation 45 does not unduly limit the speed of through-put for a particular print job. Hence, the above described arrangement of elements increases the production rate of the turret decorator 10 over a synchronized central rotational spindle drive such as was utilized in prior art systems.

Figure 15:
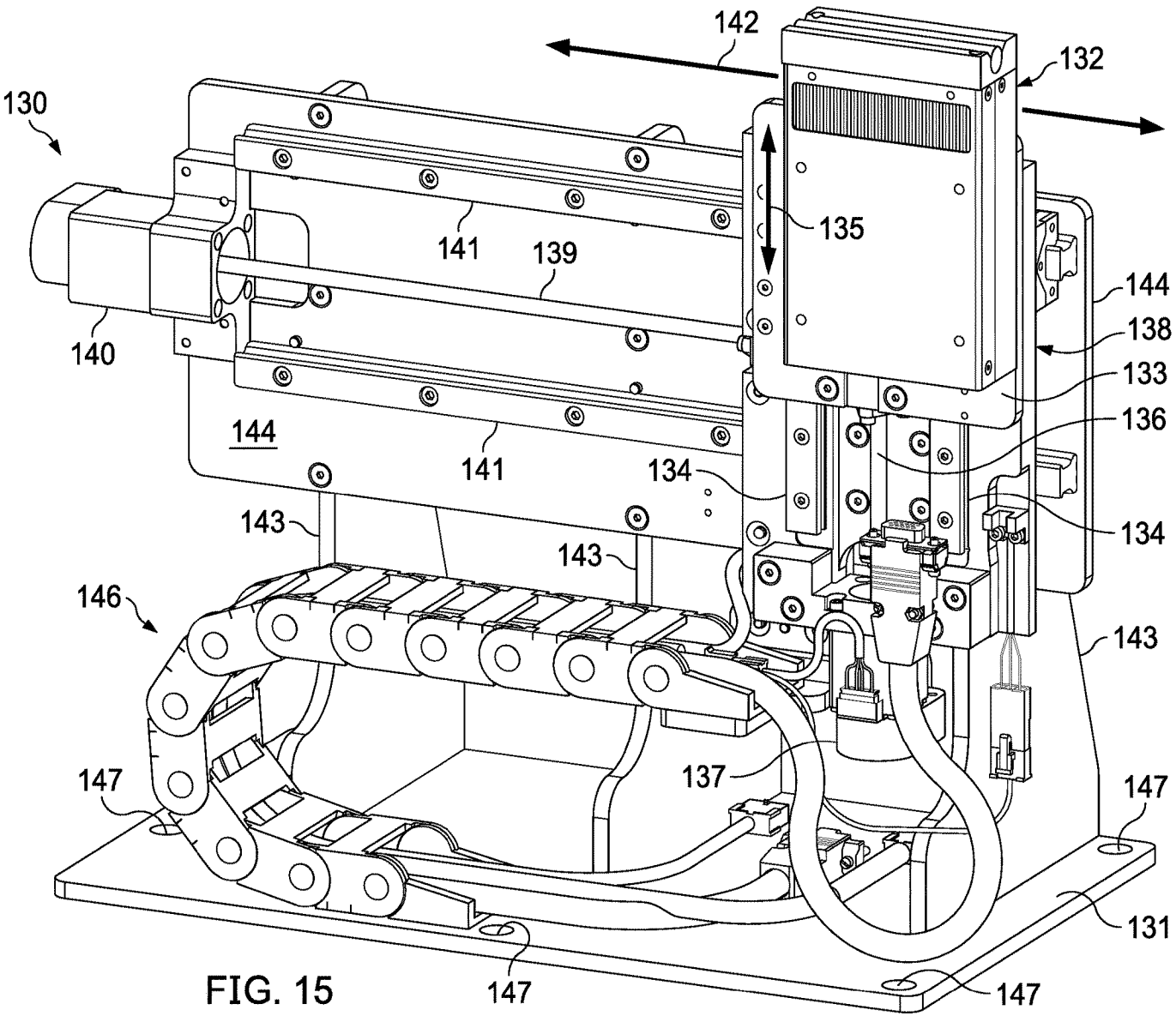
FIG. 15 is side perspective view of the modular curing assembly.
Figure 16:
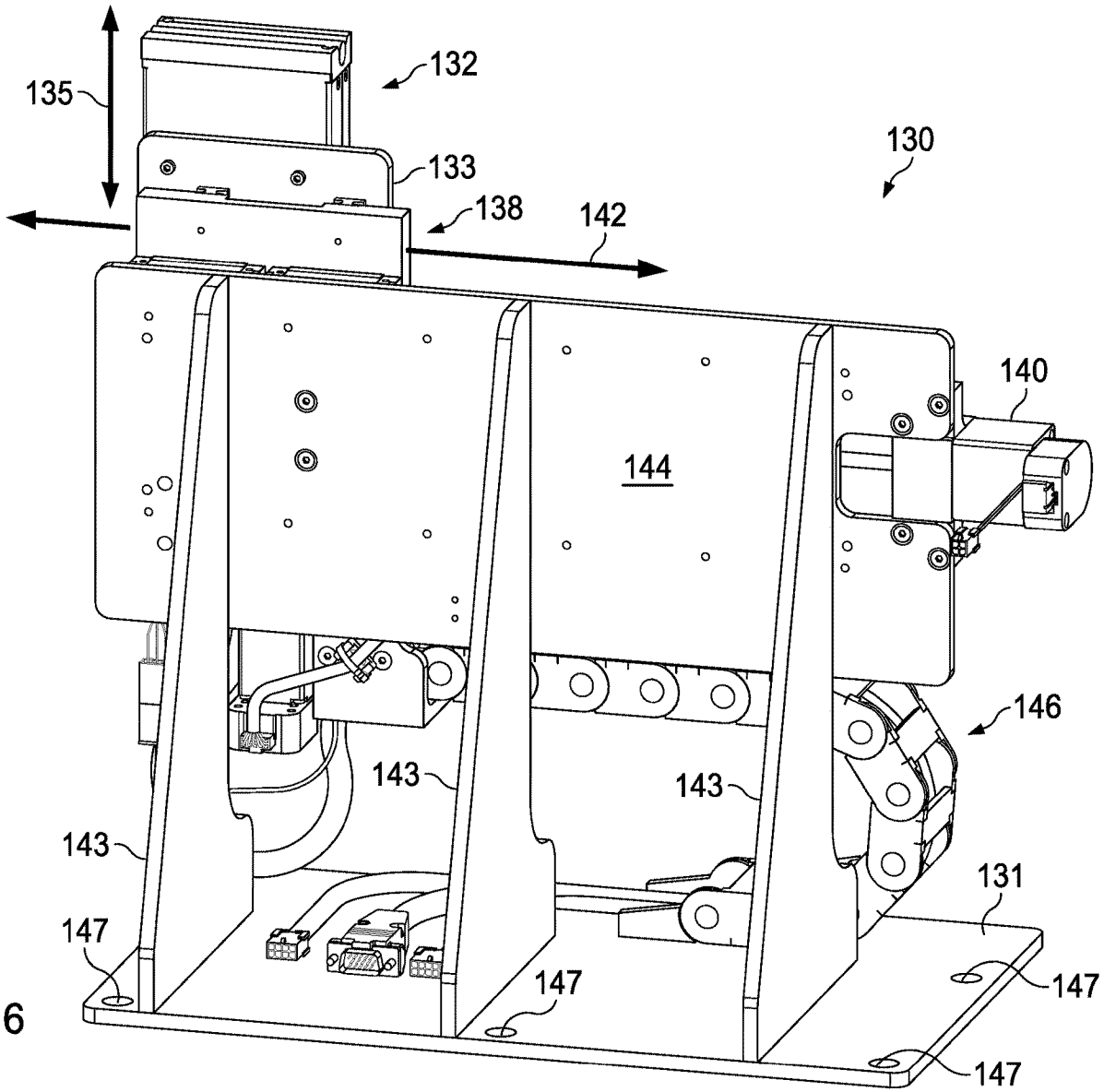
FIG. 16 is a side perspective view of the modular curing assembly from the side away from the side shown in FIG. 15.

Referring to FIGS. 15 and 16, the lower portion of the workstation 45 shows the curing assembly 130. Each assembly includes a cure lamp 132 affixed to a cure lamp backing plate 133 and mounted on a pair of vertical rails 134. The backing plate is supported by a vertical rod or thread screw 136 rotated by a stepper motor 137. Stepper motor 137 is internally indexed to allow for rotation of screw 136 in precise increments to allow to the raising and lowering of cure lamp 132 with precision along vertical path 135. A lateral cure carriage 138 supports rails 137 and is connected to a lateral thread screw 139. Carriage 138 is laterally supported by a pair of rails 141 that permit the lateral movement of cure lamp 132 along path 142 as a stepper motor 140 rotates screw 139. This allows the cure lamp to be longitudinally moved along the length of any piece of media from underneath and tack or fully cure ink that has been applied to the surface of the media as it rotates around the servo axis 122. The vertical or "Z-axis" stepper motor 137 raises and lowers the cure lamp so that the cure lamp may accommodate different diameters of media 24 and too position the emitter in the cure lamp 132 into a suitable spaced relation to the surface of the media 121 so that ink is fully or partially cured in a controllable fashion. An articulating cable carrier 146 allows for free movement of the cure carriage 138 so that the carriage is electrically connected to the machine motion controller at all times and so that the cure lamp may move along the entire length of the media 24 while holding various electrical connectors as the cure lamp emitter projects ultraviolet radiation onto surface 121 of media 24. As may be seen in the figures, a series of parallel braces 143 and a vertical support plate 144 are rigidly mounted to pedestal 131, with the pedestal bolted through apertures 147 to platform 14 so that the 3-dimensional position of cure lamp 132 may be controlled with precision relative to the media. The arrangement allows for the rapid interchange of a cure lamp for maintenance, adjustment of the curing assembly 130 to accommodate different sizes of media, or the replacement of ultraviolet light emitters with a differing strength. Hence, the cure assembly 130 is modularized such that single or multiple cure lamps may be utilized at various power output levels to accommodate various types of inks and media sizes. This also allows for the ability to cure larger diameters of media such as media having a diameter greater than 4 inches while appropriately tacking ink to the surface of the media as it rotates and indexes from print station 45 to print station 45. This modularization of the cure lamps also allows the decorator 10 to process larger diameter media sizes than were previously unavailable to be processed by prior turret decorator designs.

In operation, an operator would use a third-party software CAD program to describe and produce movement or "CAM" table specific for a particular print job for a targeted media size. In addition, a graphic file for a design to be printed onto the surface of the media is converted into a format acceptable for printing. A ripping tool then generates a printer specific file representing the image to be printed and media object geometries recorded in a geometry file. The printer specific files and geometry files for the media object to be printed are then transferred via a network connection utilized on the factory floor to a computing device, such as a laptop computer or PC workstation, stationed on the machine 10 or operationally connected adjacent to the machine 10. A standard off-the-shelf inkjet print engine is utilized in machine 10 and is operationally connected to the computing device, with all necessary support files as required by print engine supplied by the computing device. Inks suitable for the object surface print job are preloaded in machine 10 and made ready for use by adjusting the pressures for each print color in the ink supply system as is known. A complete description of computer control for providing a user control interface, downloading of images for printing into machine 10, and the configuration of a motion controller to control coordinated movement within system 10 is not necessary for complete understanding of the herein described invention. Nevertheless, suitable elements to achieve these functions may be found in U.S. patent application Ser. No. 16/526,604, filed 30 Jul. 2019, now issued as U.S. Pat. No. 10,710,378, as described on pages 22-35, and FIGS. 12-14b, as originally filed, the contents of which are hereby incorporated by reference.

An operator also would install end stocks fitted to hold the ends of the blank media 22 and adjust the distance of the media holding means carriage assembly 88 so that upon loading, each blank media 22 is held firmly within each holding means 51 and the media may spin in a rotationally balanced manner. The print profile controls the spin rate, the printing instances via ink heads 116, and curing duration and distance for each print job.

Blank media 22 to be printed is loaded by an operator onto loading conveyor 19 and carried into a loading workstation where loading rod 29 moves media 22 onto a waiting holding means 51. The position of the conveyor relative to the media holder and the timing of the movement of each media 22 is synchronized such that the media is seated against end stock 97. At a timed moment, media carriage 88 moves forward toward media 22 and extends vacuum controlled rod 104 to cause end stock 94 to engage the distal end of media 22, thereby biasing media 22 against end stock 97. Each piece of media is placed on conveyor 19 so that upon loading of the media within each media holder 51 at the loading workstation 45, the media is rotationally oriented within the media holder at a known rotational index point. The use of preconfigured end stocks, allows for each piece of media to be properly aligned with the rotational axis 122 of the axis of rotation of servo assembly 99.

After the loading of loading conveyor and configuration of the machine 10, an operator selects controls on an HMI (Human Machine Interface) on the computing device, such as a Windows notebook or PC, for controlling machine 10 to initiate a print job. Each blank piece of media 22 is spun at a predetermined, independent rotation rate within each holding means 51 suitable for the application of ink for each print workstation 45. Importantly, the rotation of each piece of media that is in process 24 moving from processing compartment 110 to processing compartment 110, is continuous throughout each print job, thereby reducing the stress upon rotating elements in system 10 and removing any processing time to accelerate and decelerate any piece of media 24 during a print job. The rotational movement of turret 18 is coordinated such that each pie section 56 holding a holding means 51 is moved continuously in a clock-wise direction so that each media 24 has a different color or image portion applied to its surface and tacked upon the surface 121 in preparation for the next color or image portion to be applied at the next station, with each station successively applying its printing step to the media surface until completion at a final print station. Each section 56 in turret 18 is moved from station to station in a precise indexed manner, pausing for just enough time to allow a station to apply its pre-programmed image portion onto the object surface 121 at the correct rotational location along a predetermined print path and location on the object surface. Typically, as is known, a different color or "color plane" will be applied to surface 121 at a different print station 45 as the media 24 moves successively from work processing compartment 110 to work processing compartment 110. As may be understood, each print head color is overlapped in a coordinated fashion at the same location on the object's surface so that predetermined colors are achieved on the objects surface to create a preloaded image. As will also be understood, motion control signals are issued by the motion controller and synchronized with a print engine via an encoder such that each print head 116 moves into position in a spaced and parallel relation to the surface 121 of the media 24 as the ink head is moved along a print path, applying ink at the precise location along the media surface. Individual UV lamps 132 held in curing lamp assembly 130 are moved up and down to conform in a spaced relation to media surface 121 underneath rotating media 24 as it progresses along a print, thereby curing the ink applied to the surface of media 24 to a predetermined extent. Generally, each curing lamp 132 moves in a coordinated fashion with the lateral movement of ink head 116 as it traverses laterally along media spin axis 122. Once an image has been printed upon the media surface 24, the ink head 116 and cure lamp 132 are returned to a home position in preparation for the arrival of the next section 56 of turret 18 for processing. The printing process is repeated at each processing section 110 until all processing printing and curing steps are completed. A final print station may optionally apply a greater amount of ultraviolet radiation so that a final coat of ink on media 24 may be permanently hardened. Once all printing and curing is completed, each printed media 23 may be offloaded via retractor 32 onto offloading conveyor 21 for further processing within the factory. While the exemplary system 10 shown includes 2 loading and 7 printing stations, that number may be adjusted for different types of media and processing speeds using the same basic elements and steps herein disclosed, as will be understood. In addition, while a 9 section pie shaped division is shown in the exemplary embodiment to hold the media holding means, it is anticipated that the size of the turret 17 may be resized to increase or decrease the number of pie shaped section, thereby increasing or decreasing the number of sections to hold a cooperatively sized media holding means.

While I have shown my invention in one form, it will be obvious to those skilled in the art that it is not so limited but is susceptible of various changes and modifications without departing from the spirit thereof.

Having set forth the nature of the invention, what is claimed is:

1. A method for decorating a container, comprising the steps of:

a. loading an undecorated piece of container media onto a rotating turret assembly having a plurality of media carriages spaced around its perimeter, wherein each said media carriage rotatably holds said loaded piece of container media;

b. indexing said rotating turret such that each said media carriage moves through a plurality of printing workstations for decorating each piece of media, wherein as each said media carriage pauses at each printing workstation ink is applied to the exterior of said media to decorate said media;

c. wherein during said indexing step each said piece of media is continually rotated within said media carriage, and wherein the rate of said rotation for each said piece of media varies from any other piece of media being simultaneously decorated in order to optimize the printing speed of decorating all container media being decorated; and, d. after said decorating step, unloading said decorated container media for further processing in a manufacturing facility.

2. The decorating method of claim 1, wherein said loading step comprises the steps of:

a. moving an undecorated container media onto one of said media carriages;

b. clamping said container media in a pair of end stocks, wherein one of said end stocks is coupled to a rotational actuator; and, c. engaging said rotational actuator as directed by a motion controller electrically connected to each media carriage to cause rotation of said loaded media via one of said end stocks.

3. The decorating method of claim 2, wherein said loading step further comprises the steps of:

a. moving a carriage assembly held by said media carriage toward the center of said turret assembly such that said container media is biased against an end stock sized to clamp onto one end of said media; and, b. locking said carriage assembly against said media such that said media is held stationary in said media carriage in a rotationally controllable manner.

4. The decorating method of claim 3, wherein said decorating step further includes the steps of:

a. positioning a computer controlled inkjet printer head above the surface of said media;

b. moving said inkjet head over the surface and depositing a layer of ink downward onto the surface of said media during rotation of said same to form an image on the surface of said media; and, c. simultaneously with said ink depositing step, applying ultraviolet radiation to the surface of said media to cause the curing of said deposited ink.

5. The decorating method of claim 1, wherein said decorating step further includes the steps of:

a. positioning a computer controlled inkjet printer head above the surface of said media;

b. moving said inkjet head over the surface and depositing a layer of ink downward onto the surface of said media during rotation of said same to form an image on the surface of said media; and, c. simultaneously with said ink depositing step, applying ultraviolet radiation to the surface of said media to cause the curing of said deposited ink.

6. The decorating method of claim 5, wherein said decorating step further includes the steps of:

a. positioning at least two computer controlled inkjet printing heads side-by-side to one another along a single radial line from a hub of said turret assembly; and, b. simultaneously moving said inkjet printing heads along the surface of said rotating container media parallel to the axis of rotation of said media such that each printing head simultaneously prints over non-overlapping areas of said media during rotation thereof.

7. The decorating method of claim 6, wherein said decorating step further includes the step of applying a different color plane of ink to said container media at a different print station to achieve a desired color decorating result.

8. The decorating method of claim 1, wherein said decorating step is coordinated by a motion controller responsive to a unique print profile assigned to a particular container media print job.

9. The decorating method of claim 8, wherein said step of rotating said loaded media further includes the step of driving a rotational actuator with a dedicated electronic servo driver held in a hub of said turret assembly responsive to signals received from an electronic motion controller, and wherein said signals are communicated across a slip ring assembly surrounding a rotational shaft supporting said turret assembly.

10. The decorating method of claim 9, wherein said indexing step comprises rotating said turret assembly in a rotational orientation that forms a non-intersecting plane with the plane of a manufacturing floor supporting a decorating machine executing said decorating method.

11. The decorating method of claim 10, further including the steps of loading and unloading said container media from a pair of conveyors.

12. The decorating method of claim 1, wherein after said decorating step moving said media carriage through a dedicated curing workstation for curing deposited ink on the surface of said container media.

13. In a container decorator machine having a rotatable turret assembly and holding a plurality of circumferentially disposed media carriages at its periphery, said turret assembly arranged to rotate about a central axis in a controlled manner such that each said media carriages advances along a circular path from one index point to another index point along the circumference of said turret assembly, and wherein a plurality of workstations are positioned around the periphery of said rotatable turret at each index point for executing a decorating action on container media loaded onto said decorator machine, a decorating method using said decorator machine, comprising the steps of:

a. loading an undecorated piece of container media onto said rotating turret assembly such that said media is rotatably clamped within a media carriage at each end of said media;

b. within a plane disposed horizontally and parallel with respect to a floor surface plane supporting said container decorator machine, rotating said rotating turret such that said media carriage advances to a printing workstation and pauses for a decorating action;

c. during said turret rotating step, rotating said media container in said media carriage continuously at a rate optimized for minimizing the time required to finish a printing action at each print station, wherein said step of rotating said media comprises orienting the axis of rotation of said media within said horizontally oriented parallel plane and further having the axis of rotation of said media pointed toward the center of said turret; and, d. advancing said media carriage in a downstream direction and pausing at a series of print workstations for further decorating actions until said container media has been fully decorated; and, e. unloading said decorated container media for further processing in a manufacturing facility.

14. The decorating method of claim 13, wherein said decorating action step further includes the steps of:

a. positioning a computer controlled inkjet printer head above the surface of said media;

b. moving said inkjet head over the surface and depositing a layer of ink downward onto the surface of said media during rotation of said same to form an image on the surface of said media; and, c. simultaneously with said ink depositing step, applying ultraviolet radiation to the surface of said media to cause the curing of said deposited ink.

15. The decorating method of claim 14, wherein said decorating action step further includes the steps of:

a. positioning at least two computer controlled inkjet printing heads side-by-side to one another along a single radial line from a hub of said turret assembly; and, b. simultaneously moving said inkjet printing heads along the surface of said rotating container media parallel to the axis of rotation of said media such that each printing head simultaneously prints over non-overlapping areas of said media during rotation thereof.

16. The decorating method of claim 15, wherein said decorating action step further includes the step of applying a different color plane of ink to said container media at a different print station to achieve a desired color decorating result.

17. The decorating method of claim 13, wherein said loading step comprises the steps of:

a. moving an undecorated container media onto one of said media carriages;

b. clamping said container media in a pair of end stocks, wherein one of said end stocks is coupled to a rotational actuator; and, c. engaging said rotational actuator as directed by a motion controller electrically connected to each media carriage to cause rotation of said loaded media via one of said end stocks.

18. A method of decorating a piece of container media, comprising the steps of:

a. loading an undecorated piece of container media onto a rotating turret assembly in which said container media is rotatably clamped within a media carriage at the ends of said container media, wherein said loading step includes the action of moving a carriage assembly toward the center of said turret assembly such that said container media is biased against an end stock sized to clamp onto one end of said media;

b. locking said carriage assembly against said container media such that said container media is held stationary in said media carriage in a rotationally controllable manner;

c. rotating said rotating turret such that said media carriage assembly advances to a printing workstation and pauses for a decorating action; and, d. during said turret rotating step, continuously rotating said media container in said media carriage at a rate optimized for minimizing the time required to finish a printing action at each printing workstation.

19. The decorating method of claim 18, wherein said decorating action step further includes the steps of:

a. positioning a computer controlled inkjet printer head above the surface of said media;

b. moving said inkjet head over the surface and depositing a layer of ink downward onto the surface of said media during rotation of said same to form an image on the surface of said media; and, c. simultaneously with said ink depositing step, applying ultraviolet radiation to the surface of said media to cause the curing of said deposited ink.

20. In a container decorator machine having a rotatable turret assembly and holding a plurality of circumferentially disposed media carriages at its periphery, said turret assembly arranged to rotate about a central axis in a controlled manner such that each said media carriages advances along a circular path from one index point to another index point along the circumference of said turret assembly, and wherein a plurality of workstations are positioned around the periphery of said rotatable turret at each index point for executing a decorating action on container media loaded onto said decorator machine, a decorating method using said decorator machine, comprising the steps of:

a. loading an undecorated piece of container media onto said rotating turret assembly such that said media is rotatably clamped within a media carriage at each end of said media;

b. rotating said rotating turret such that said media carriage advances to a printing workstation and pauses to execute a decorating step to apply ink over the surface of said media;

c. wherein said decorating step includes positioning at least two computer controlled inkjet printing heads side-by-side to one another along a single radial line from a hub of said turret assembly and simultaneously moving said inkjet printing heads along the surface of said rotating container media parallel to the axis of rotation of said media such that each printing head simultaneously prints over non-overlapping areas of said media during rotation thereof;

d. wherein said turret rotating step comprises rotating said turret assembly in a rotational orientation that forms a non-intersecting plane with the plane of a manufacturing floor supporting said decorating machine;

e. during said turret rotating step, rotating said media container in said media carriage continuously at a rate optimized for minimizing the time required to finish a decorating step at each print station; and, f. advancing said media carriage in a downstream direction and pausing at a series of print workstations for a decorating step until said container media has been fully decorated; and, g. unloading said decorated container media for further processing in a manufacturing facility.

* * * * *